US010271631B2

(12) United States Patent
Ports et al.

(10) Patent No.: US 10,271,631 B2
(45) **Date of Patent: *Apr. 30, 2019**

(54) BEAUTY PRODUCT DISPLAYS

(71) Applicant: One Source Industries, LLC, Irvine, CA (US)

(72) Inventors: Richard Allen Ports, San Clemente, CA (US); Rodney Bennett Miller, Lake Forest, CA (US); Jason Rockford Wheaton, Cerritos, CA (US)

(73) Assignee: One Source Industries, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/868,196

(22) Filed: Jan. 11, 2018

(65) Prior Publication Data

US 2018/0199696 A1 Jul. 19, 2018

Related U.S. Application Data

(63) Continuation of application No. 15/199,483, filed on Jun. 30, 2016, now Pat. No. 9,877,568, which is a (Continued)

(51) Int. Cl.
*A45D 44/00* (2006.01)
*A47F 5/00* (2006.01)

(Continued)

(52) U.S. Cl.
CPC ..... *A45D 44/005* (2013.01); *A47F 1/12* (2013.01); *A47F 5/005* (2013.01); *A47F 5/0025* (2013.01);

(Continued)

(58) Field of Classification Search
CPC ..... A47F 5/00; A47F 5/0043; A47F 5/0068; A47F 7/02; A47F 7/03; A45D 44/005

(Continued)

(56) References Cited

U.S. PATENT DOCUMENTS 2,300,170 A 9/1941 Pickard
2,393,371 A 1/1946 Irene (Continued)

FOREIGN PATENT DOCUMENTS

FR 1589683 4/1970
FR 2797758 3/2001

(Continued)

OTHER PUBLICATIONS

International Search Report and Written Opinion dated Mar. 18, 2015, International Application No. PCT/US2014/067722.

(Continued)

*Primary Examiner* — Joshua E Rodden
(74) *Attorney, Agent, or Firm* — Knobbe, Martens, Olson & Bear, LLP

(57) ABSTRACT

Devices and methods for displaying beauty and other visual products are disclosed. A display system can comprise a frame and a sample portion. Traits such as color and texture of a beauty product can be displayed on the sample portion, and the frame portion can interface with product shelving to align samples with relevant products in the display. The sample portion can be releasably attached to the frame to be removed by a user and be placed above a body part of the user to which a beauty product may be applied, or a body part can be placed in proximity to the sample portion even while it is attached to the frame. The user can advantageously view the beauty product as applied to the body part without applying the beauty product. The system is useful for fingernail polish display, for example.

21 Claims, 15 Drawing Sheets

Related U.S. Application Data continuation of application No. 14/555,185, filed on Nov. 26, 2014, now Pat. No. 9,380,853.

(60) Provisional application No. 62/025,443, filed on Jul. 16, 2014, provisional application No. 61/909,997, filed on Nov. 27, 2013.

(51) Int. Cl.

| | |
|---|---|
| ***A47F 7/00*** | (2006.01) |
| ***A47F 1/12*** | (2006.01) |
| ***A47F 7/28*** | (2006.01) |
| ***G09F 3/20*** | (2006.01) |

(52) U.S. Cl.

CPC ..... *A47F 7/0007* (2013.01); *A47F 7/286* (2013.01); *G09F 3/204* (2013.01); *Y10T 29/49895* (2015.01)

(58) Field of Classification Search

USPC ..... 211/59.4, 123, 124; 434/100

See application file for complete search history.

(56) References Cited

U.S. PATENT DOCUMENTS

| | | | |
|---|---|---|---|
| 2,417,677 | A | 3/1947 | Cohan |
| 3,070,906 | A | 1/1963 | Tinsley |
| 3,295,690 | A | 1/1967 | Ottman |
| 3,485,344 | A | 1/1968 | Aylott |
| 3,774,993 | A | 11/1973 | Senff |
| 3,964,709 | A | 6/1976 | LaBelle |
| 3,982,551 | A | 9/1976 | Bartolucci |
| 4,106,614 | A | 8/1978 | Aylott |
| 4,140,139 | A | 2/1979 | Aylott |
| 4,215,840 | A | 8/1980 | Babberl |
| 4,352,478 | A | 10/1982 | Loew |
| 4,401,222 | A | 8/1983 | Kulikowski |
| 4,629,072 | A | 12/1986 | Loew |
| 4,896,779 | A | 1/1990 | Jureckson |
| 4,968,253 | A | 11/1990 | Thomas |
| 5,031,647 | A | 7/1991 | Seidler |
| 5,131,563 | A | 7/1992 | Yablans |
| 5,188,222 | A | 2/1993 | Pierce |
| 5,190,186 | A | 3/1993 | Yablans |
| 5,265,738 | A | 11/1993 | Yablans |
| 5,312,000 | A | 5/1994 | Bass |
| 5,542,552 | A | 8/1996 | Yablans |
| 5,570,793 | A | 11/1996 | Killough |
| 5,647,485 | A | 7/1997 | Verrangia |
| D385,694 | S | 11/1997 | Magnussen |
| 5,791,482 | A | 8/1998 | Murphy |
| 5,816,408 | A | 10/1998 | Indelicato |
| 5,833,077 | A | 11/1998 | Engel |
| 5,915,856 | A | 6/1999 | Yeranossian |
| 6,076,670 | A | 6/2000 | Yeranossian |
| 6,199,724 | B1 | 3/2001 | Yeranossian |
| 6,318,566 | B1 | 11/2001 | Davis |
| 6,336,564 | B1 | 1/2002 | Garnier |
| 6,354,447 | B1 | 3/2002 | Brown |
| 6,767,234 | B1 | 7/2004 | Rosa |
| 7,185,452 | B2 | 3/2007 | Brown |
| 7,654,497 | B1 | 2/2010 | Karan |
| 8,215,795 | B2 | 7/2012 | Pichel |
| 8,561,817 | B1 | 10/2013 | Allen |
| 8,646,935 | B2 | 2/2014 | Karan |
| 8,925,744 | B1 | 1/2015 | Jang |
| 2006/0151408 | A1 | 7/2006 | Gaynor |
| 2012/0097626 | A1 | 4/2012 | Deguglimo |
| 2012/0329011 | A1 | 12/2012 | Clark |
| 2013/0213911 | A1 | 8/2013 | Theisen |
| 2014/0218896 | A1 | 8/2014 | Karan |
| 2014/0250749 | A1 | 9/2014 | Theisen |
| 2014/0251931 | A1 | 9/2014 | Theisen |

FOREIGN PATENT DOCUMENTS

| | | | |
|---|---|---|---|
| JP | S58185111 | U | 12/1983 |
| JP | 60-152173 | U1 | 10/1985 |
| JP | 3010780 | U | 5/1995 |
| JP | 10-291915 | | 4/1998 |
| WO | WO1998/024348 | A1 | 6/1998 |
| WO | WO2011/132180 | A3 | 3/2012 |

OTHER PUBLICATIONS

Photograph of a sample taken on Feb. 19, 2015. The nail tip display and the frame were available on or before Nov. 27, 2013, the filing date of the U.S. Appl. No. 61/909,997.

Web page titled "Product Details," http://www.popai.com/creative-gallery-1/1-39-oreal-promanicure-nail-trays, 2 printed pages, printed on Jan. 25, 2016.

Ando, Hideyuki, et al., SmartFinger: nail-mounted tactile display, ACM SIGGRAPH 2002 conference abstracts and applications, Jul. 21-26, 2002, 78, ACM New York, NY, USA.

Ando, Hideyuki, et al., A fingernail-mounted tactile display for augmented reality systems, Electronics and Communications in Japan (Part II: Electronics), Mar. 28, 2007, 56-65, vol. 90, Issue 4.

Ando, Hideyuki, et al., Nail-mounted tactile display for boundary/texture augmentation, ACE '07 Proceedings of the international conference on Advances in computer entertainment technology, Jun. 13-15, 2007, 292-293, ACM New York, NY, USA.

Ando, Hideyuki, et al., The nail-mounted tactile display for the behavior modeling, ACM SIGGRAPH 2002 conference abstracts and applications, Jul. 21-26, 2002, 264, ACM New York, NY, USA.

Apolinar, E., et al., Examination of Human Fingernail Ridges by Means of Polarized Light, Journal of Forensic Sciences 1980, 154-161, vol. 25, No. 1.

Morgan Taylor Professional Nail Lacquer, CreativeServer:HM-MorganTaylorjobs:000-MT_360Sideless_Rack: mt_360pcdisplay.jpg, Oct. 4, 2012.

Niwa, Masataka, et al., Fingernail-Mounted Display of Attraction Force and Texture, EuroHaptics 2010, Part II, 2010, 3-8, LNCS 6192, Springer, Berlin, Heidelberg.

Su, Chao-Huai, et al., NailDisplay: bringing an always available visual display to fingertips, CHI '13 Proceedings of the SIGCHI Conference on Human Factors in Computing Systems, Apr. 27-May 2, 2013, 1461-1464, ACM New York, NY, USA.

Wimmer, Raphael, et al., Exploring the benefits of fingernail displays, CHI '13 Extended Abstracts on Human Factors in Computing Systems, Apr. 27-May 2, 2013, 937-942, ACM New York, NY, USA.

BEAUTY PRODUCT DISPLAYS

REFERENCE TO RELATED APPLICATIONS

Any and all applications for which a foreign or domestic priority claim is identified in the Application Data Sheet as filed with the present application are hereby incorporated by reference under 37 CFR 1.57. This application is a continuation of U.S. application Ser. No. 15/199,483, titled Beauty Product Displays, filed Jun. 30, 2016, which is a continuation of U.S. patent application Ser. No. 14/555,185, titled Beauty Product Displays, filed Nov. 26, 2014, which claims priority under 35 U.S.C. § 119 to U.S. to Provisional patent applications, which are hereby incorporated by reference in their entirety: U.S. Provisional Patent Application No. 61/909,997, filed Nov. 27, 2013, titled Devices and Methods for Displaying Beauty Product Colors, U.S. Provisional Patent Application No. 62/025,443, filed Jul. 16, 2014, titled Devices and Methods for Displaying Beauty Product Colors. The entire disclosures of each of the foregoing applications are hereby made part of this specification as if set forth fully herein and incorporated by reference for all purposes, for all that each contain.

BACKGROUND

Field

The disclosure generally relates to product sample displays.

Related Art

Finger nail polish typically comes in small transparent bottles that either display the color of the nail polish through their clear sides or at least include a label or lid that provides color information to a potential consumer. However, provided herein are devices and methods that can help a consumer gain more useful information relating to finger nail polish, for example.

SUMMARY

The present technology relates to devices and methods for displaying beauty products and samples that may include colors.

A beauty product sample display system can comprise, for example: a frame configured for attachment to an elongate row of product shelving organizing beauty products in elongate columns that are perpendicular with respect to the elongate row. The elongate row of product shelving can be configured to be positioned near a consumer space such that multiple elongate columns of beauty products are visible to consumers. Each elongate column can contain beauty products having the same color or other visual property, the beauty products arranged in a series, one behind another, in the elongate column. The frame can be further configured to releasably accept multiple swatch pieces and associate each swatch piece with a corresponding elongate column of beauty products by positioning one swatch piece adjacent to—and aligning that swatch piece with—each elongate column of beauty products. A beauty product sample display system can further comprise multiple swatch pieces. Swatch pieces can comprise a sample portion that can be configured to contain or display beauty product samples and expose the beauty products' colors or other visual properties for close inspection by a consumer, each sample portion configured to protrude outward, away from the product shelving and into the consumer space to allow consumers to interact with the sample portion and closely evaluate the color or other visual property. Swatch pieces can further comprise a label portion that can be configured to contain or display a label identifying the name or source of the beauty product sample. Swatch pieces can further comprise at least one slot engagement protrusion. The frame can further comprise one or more frame slots for accepting the slot engagement protrusions of each of the multiple swatch pieces, the one or more frame slots positioned to allow the multiple swatch pieces to slide into alignment with the corresponding elongate column of beauty products. The sample portion can be thin and generally shaped like a fingernail with the fingernail tip extending toward the frame and the fingernail base extending away from the frame toward the consumer space. A consumer in the consumer space can place her fingernail immediately underneath the sample portion to see the visual effect the beauty product would produce if placed directly on her fingernail in the context of her skin color.

The frame can be configured for removable attachment to the elongate shelving. For example, the frame can include a hanging portion. The swatch piece can have a width of at least 0.75 inches. The swatch piece can protrude from the frame by at least 0.1 inches. The frame can be configured for adhesion to the elongate shelving. For example, the frame can include a strip of adhesive with a removable cover to facilitate the adhesion. The frame can comprise at least one frame protrusion. The swatch piece can comprise at least one swatch piece slot that can be configured to accept the frame protrusion to assist in physical support and alignment of the swatch pieces with the corresponding elongate columns of beauty products. The slot engagement protrusion can comprise a button. The one or more frame slots can comprise a retention mechanism. The retention mechanism can comprise, for example, a retention device comprising a button hole configured to removably lodge the at least one button, a channel extending from an edge of the frame toward the elongate row of product shelving, and a ridge disposed between the channel and the retention device. The button of the retention mechanism can slide through the channel, over the ridge, and into the button hole, and the frame can thereby retain the swatch piece.

The beauty product sample display system can be configured such that the swatch piece experiences limited torsional stress during insertion and removal. The stress can reach a maximum when the button passes over the ridge. The display swatch can comprise a sample portion shaped like a finger nail. The sample portion of the display swatches can have a superior concave surface configured to be directly exposed and visible to a consumer for displaying a beauty product while generally covering a human finger nail, a corresponding anterior convex surface configured to allow a human finger nail to nest immediately adjacent thereto; and a curved edge shaped to abut a standard cuticle such that the sample portion tends to fully cover a user's finger nail and display a beauty product color adjacent the skin of a user.

A method of displaying beauty product samples in association with beauty products can comprise, for example, providing a rigid plastic detachable swatch piece configured to protrude outward from product shelving and toward a consumer space. The swatch piece can comprise a sample portion configured to accept a beauty product for direct display to a consumer, and a connecting mechanism comprising at least one channel interface feature. A method of displaying beauty product samples in association with beauty products can comprise, for example, providing a frame configured for attachment to an elongate row of product shelving organizing beauty products in series that are perpendicular with respect to the elongate row. The frame can be configured to releasably accept multiple swatch pieces and associate each swatch piece with a corresponding series of beauty products by positioning one swatch piece adjacent to—and aligning that swatch piece with—each series. The frame can further comprise a retention mechanism configured to interface with the connecting mechanism of the swatch piece to retain the swatch piece in association with the corresponding series. The retention mechanism can comprise at least one channel. A method of displaying beauty product samples in association with beauty products can comprise positioning the swatch piece by sliding the channel interface feature into the channel of the frame to align the swatch piece with the corresponding series of beauty products. The channel can extend along the length of the frame. A method of displaying beauty product samples in association with beauty products can comprise, for example, positioning the swatch piece. Positioning the swatch piece can comprise sliding the channel interface feature laterally along the channel. The frame can comprise one channel for each series. Positioning the swatch piece can comprise sliding the channel interface feature perpendicular to an elongate axis of the frame and directly toward a specific series. The retention mechanism can comprise a second channel. For example, the two channels can comprise track slots, and the swatch piece can comprise two corresponding rail portions. The retention mechanism can comprise a ridge and a button hole. The channel can be configured to guide a button on the swatch piece in the direction of the button hole. The ridge can be configured to prevent the button from easily sliding out of the button hole.

A beauty product sample display system can comprise, for example, a channel frame. The channel frame can comprise a rack body portion having a longitudinal length, and one or more sliding channels. Sliding channels of the channel frame can comprise a track slot. The track slot can extend along the longitudinal length of the rack body portion. The beauty product sample display system can comprise one or more display swatches. The display swatch can comprise one or more rail portions disposed linearly along one or more outer edges of the one or more display swatches. The rail portions can be configured to slidably but securely fit within the track slot of the one or more sliding channels. The channel frame can be configured to slidably but securely fit one or more display swatches.

The display swatches of the beauty product display system can comprise a sample portion shaped like a finger nail. The display swatches can have a superior concave surface configured to be directly exposed and visible to a consumer for displaying a beauty product while generally covering a human finger nail, a corresponding anterior convex surface configured to allow a human finger nail to nest immediately adjacent thereto, and a curved edge shaped to abut a standard cuticle such that the sample portion tends to fully cover a user's finger nail and display a beauty product color adjacent the skin of a user. A beauty product sample display system can further comprise a theft deterrent channel lock configured to be securable to the rack body portion.

BRIEF DESCRIPTION OF THE DRAWINGS

The following drawings and the associated descriptions are provided to illustrate the present disclosure and do not limit the scope of the claims.

Figure 1:
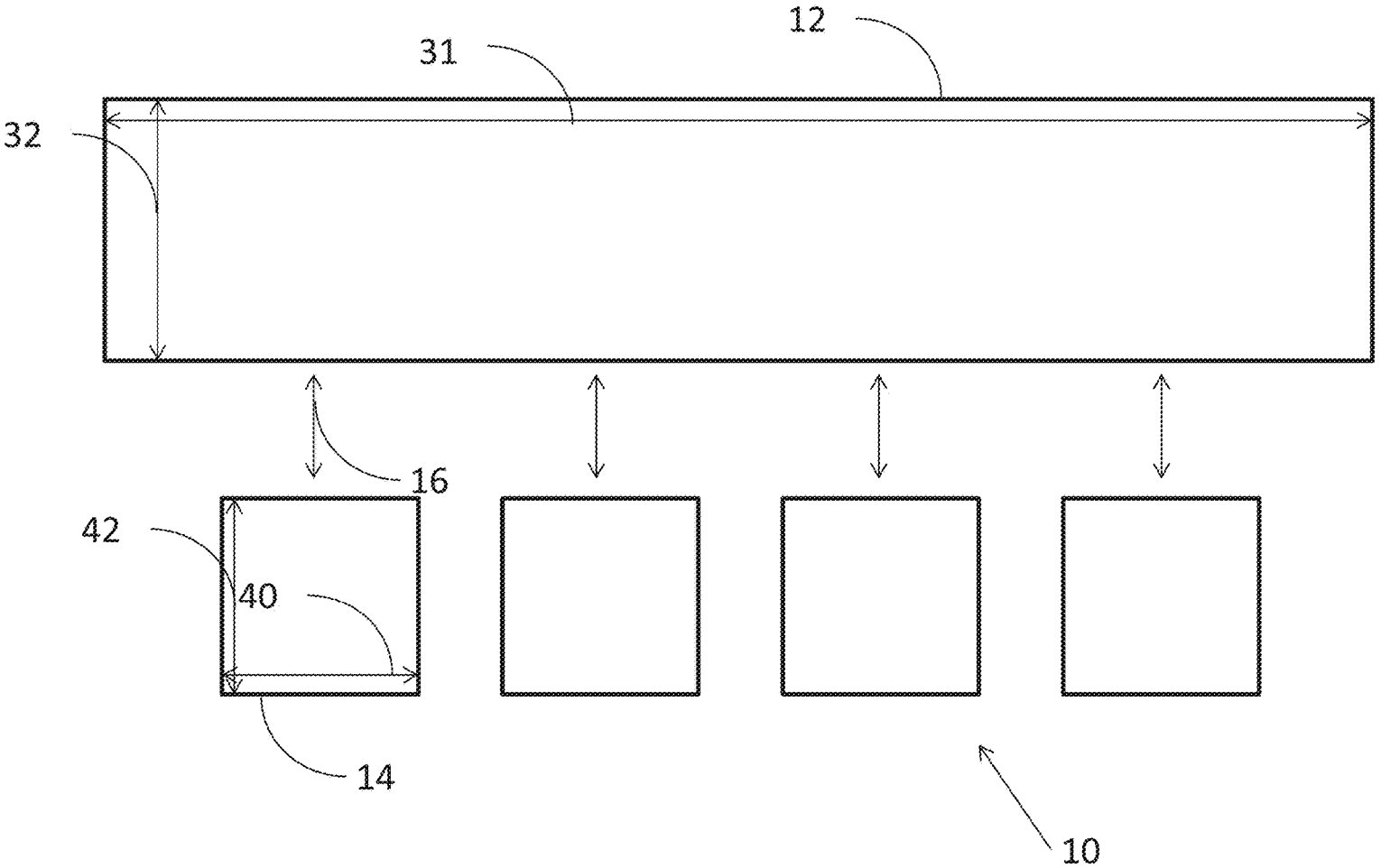
FIG. 1 shows a generalized schematic drawing of sample display system with detachable portions and a frame.

These and other features will now be described with reference to the drawings summarized above. The drawings and the associated descriptions are provided to illustrate embodiments and not to limit the scope of any claim. Throughout the drawings, reference numbers may be reused to indicate correspondence between referenced elements.

DETAILED DESCRIPTION

Although certain preferred embodiments and examples are disclosed herein, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of illustrating various feature combinations and embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

The systems and methods discussed herein can be used anywhere, including, for example, in nail salons, retail stores, department stores, wholesale stores, beauty schools, or in homes. They can be used for various beauty products involving colors, for example, fingernail and toenail coloring products. They can also be applied in other beauty product settings. Moreover, the systems and methods discussed herein can be used for selling nail polish, selling beauty product displays, to display samples and colors, to create interest in products by placing samples outside packaging, to train or practice applying nail polish, etc. It is advantageous to see how a beauty product (e.g., a nail polish) would look in context (e.g., on nails next to a customer's skin) before purchasing or applying the polish. Nail polish users may use a nail sample display system with detachable nail tip portions. This can be done, for example, in a manicure establishment, a pedicure parlor, in a beauty salon or a nail school setting, or any setting where nail polish users would benefit from viewing how a nail polish would look using more information than that provided simply by looking at or through its container or at its label. Prior art devices and systems may suffer from various drawbacks. For example, narrow portions or crowded placement on the display racks may be inconvenient. If materials are too thin, brittle, weak, etc. (whether these materials are part of the sample display system or the detachable nail tip portion), this can cause a detachable nail tip portion to fracture during use. These inconveniences can lead to breakage or dislodging of detachable nail tip portions, and can limit a display lifespan. The width of a sample display system and detachable nail tip portion may not account for the width of the product shelving and the nail polish containers, making it difficult for a user to organize or identify nail polish containers. Systems and methods described herein can mitigate and/or overcome these drawbacks, both in the context of beauty product (e.g., nail color) displays and for sample display racks in other contexts.

Nail Display Rack

FIG. 1 shows a generalized schematic drawing of a sample display system 10 that includes a detachable portion 14 and a frame 12 that can be removably attached as shown by the arrows 16. A motion used for attachment can be in the direction illustrated here, or it can also be accomplished by moving the detachable portions 14 in a direction parallel with an elongate axis (see the horizontal length 31) of the frame 12, as will be discussed further herein. The frame 12 can be of a substantially rectangular shape with a horizontal length 31 that is longer than its vertical length 32. For example, the horizontal length 31 can be approximately a multiple of the widths of a number of detachable portions 14 (also accounting for spacing between portions 14), and can be 1 to 60 inches, for example. The vertical length 32 can represent a balance between allowing enough overlap for secure attachment while reducing material cost and weight, and can be 0.3 to 2 inches, for example, or longer. The detachable portion 14 can be a swatch piece in the sense that its function can be to display or otherwise present a beauty product for comparison, including beauty products having certain visual properties such as color, texture, glossiness, etc. The detachable portion 14 can be modular and can correspond roughly to a width of a beauty product container, for example. In the illustrated schematic example, it can have a substantially square shape, with a vertical length 42 and a horizontal length 40 that can be substantially similar. For example, the vertical length 42 can be 1 to 1.5 inches, and the horizontal length 40 can be 1 to 2 inches. The vertical length 42 can be 0.8 to 1.2 inches, and the horizontal length 40 can be 0.75 to 1.5 inches. The general size and shape of a detachable portion 14 can be designed to allow a user to position a fingernail conveniently below or next to various detachable portions 14 safely and sequentially, while providing enough visual space between them to allow proper assessment of the colors of a user's hand or skin with respect to nail polish colors that may be present on the detachable portion 14. A detachable portion 14 can avoid corners and have smooth edges to avoid lacerations. A detachable portion can provide space for application of a colored beauty product such as nail polish, as well as a place for a label indicating the source of that product (e.g., a label with the name of the color and the brand, etc.) A label place can be emphasized by being recessed or it can protrude, for example, to call attention to the label or for aesthetic reasons.

It can be helpful to size and/or otherwise configure a sample display system to be easily carried and/or easily mounted. It can also be helpful to size or otherwise configure a rack to be visually unobtrusive and to avoid distracting from the beauty product colors being presented. For example, a rack can be formed from clear plastic. It can be helpful to configure a frame to allow a user to easily position their fingers or toes, for example, immediately adjacent colored beauty products. These advantages can also be accompanied by features relating to the cost of materials (lower is often better) and to general aesthetic principles. The vertical length 32 of the frame 12 can be longer or shorter than the vertical length 42 of the detachable portion 14. For example, the vertical length 32 of the frame can be 2 inches, and the vertical length 42 of the detachable portion 14 can be 1.2 inches. The detachable portion 14 can have a shorter horizontal length 40 than the horizontal length 31 of the frame 12, so that the frame 12 can house one or more of the detachable portions 14. For example, the horizontal length 40 of the detachable portion 14 can be 1 inch, and the horizontal length 31 of the frame 12 can be a multiple of the horizontal length of the detachable portions (e.g., 12 inches), or it can also account for a desired spacing between the detachable portions. The detachable portion 14 can be removably attached 16 to the frame. When being attached to the frame 12, each of the detachable portions 14 can be evenly spaced apart from each other, so as not to contact each other. The horizontal length 31 of the frame 12 can have varying lengths, so that the frame 12 can house or support a desired number of detachable portions 14.

Figure 2:
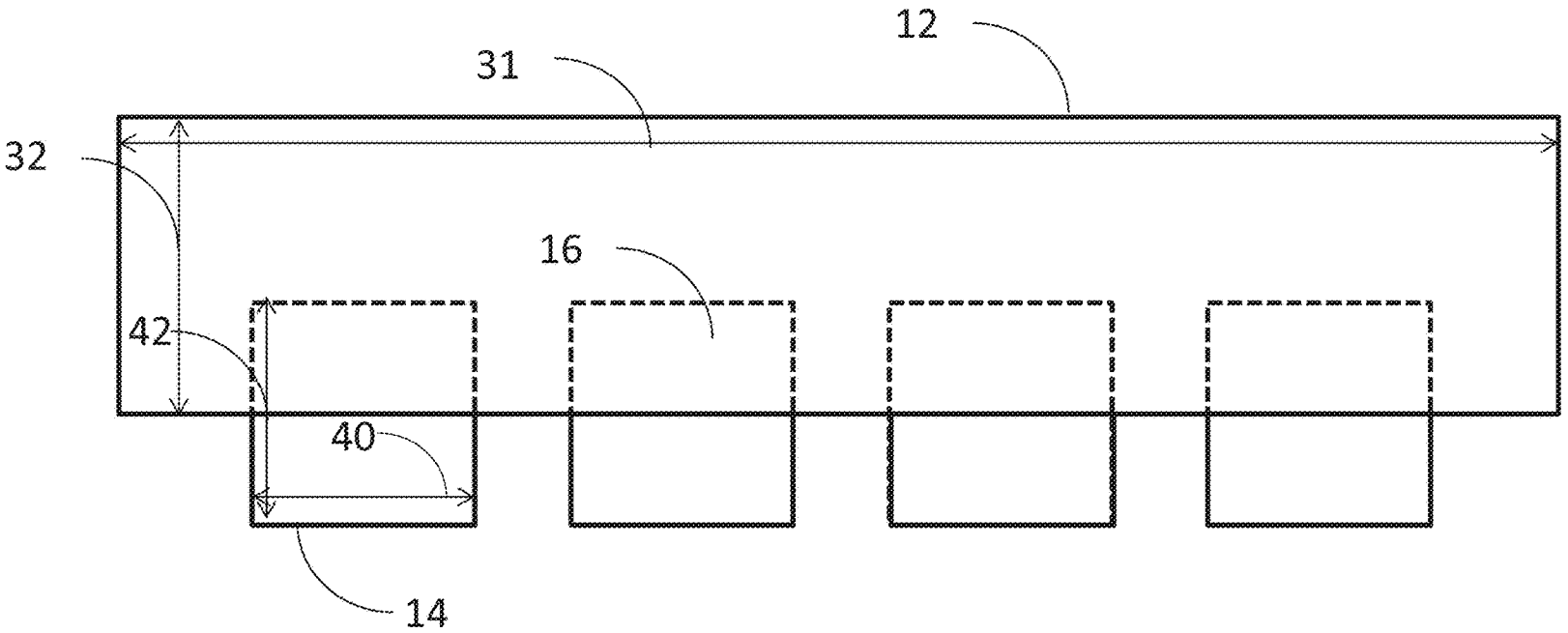
FIG. 2 illustrates schematically how the detachable portions and the frame in FIG. 1 can attach.

FIG. 2 illustrates schematically how the detachable portions and the frame in FIG. 1 can attach or associate together. The detachable portion 14 can be a swatch piece or accessible color sample that is not contained within beauty product packaging. The frame 12 can be placed in the front of the detachable portion 14, so that the frame 12 can cover a part of the detachable portion 14 when viewed from the front, as illustrated in FIG. 2. The frame portion 12 can be placed behind the detachable portion 14, so that the detachable portion 14 can cover a part of the frame 12 when viewed from the front (not shown). Or, the frame 12 and the detachable portion 14 can be mated to each other, so that either the frame 12 or the detachable portion 14 can cover only a minimal part of each other, or not cover any part of each other when viewed from the front. The frame 12 and the detachable portion can mutually attach or mate using any part of either portion, such as on the surface, on the edge(s), or both.

In operation, the detachable portion 14 can be gripped or grasped by fingers of one hand of the user, while the frame 12 can be stabilized by, for example, the other hand of the user, or a larger, substantially immobile object, such as product shelving. The user may then move the detachable portion 14 toward the frame 12 (see the attachment arrows 16 of FIG. 1); so that the detachable portion 14 and the frame 12 may mate and directly contact each other in a secured position. Once the detachable portion 14 and the frame 12 are in direct contact, the user may let go of the detachable portion 14 held in one hand, as the detachable portion 14 can remain stably connected or secured to the frame 12. Similarly, to take out the detachable portion 14 after it has been connected or secured to the frame 12, the detachable portion 14 can be held with one hand by the user, while the frame 12 can be stabilized by the other hand of the user or a larger, substantially immobile object, such as product shelving. The user may then detach the detachable portion 14 by pulling the detachable portion 14 away from the frame 12, so that the detachable portion 14 and the frame 12 no longer contact each other.

In some embodiments, the detachable nature of the detachable portions 14 may give rise to a danger that they will be removed and potentially taken away by a customer or other person. This danger can be mitigated by including a separate, looser attachment that still allows the movement described above. Accordingly, the frame 12 and the detachable portion 14 can be additionally connected 16 by ends of a filament, chain, cable, cord, or string (not shown). The frame 12 can include or be configured to interface with a larger, substantially immobile object, such as product shelving. Multiple frames 12 can be connected in parallel. This can allow a greater number of detachable portions 14 to be housed to the multiple frames 12, more than the number of detachable portions 14 that can be housed within a single frame 12. The frame 12 can have a vertical length 32 that can be similar to or substantially longer than the vertical length 42 of the detachable portion 14. Multiple detachable portions 14 can be attached 16 to the frame 12 in a row. Multiple frames 12 can be positioned in a single elongate row along a length of shelving next to a consumer aisle or other consumer space, for example. Such frames 12 positioned in a single elongate row may be substantially independent from each other, or connected to each other.

Detachable Swatch Piece

Figure 3:
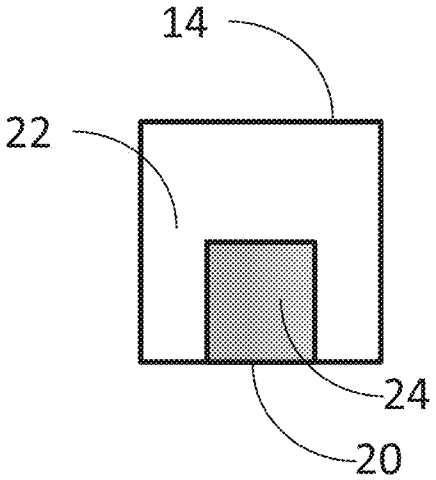
FIG. 3 illustrates a schematic detachable portion of FIG. 1 having a sample portion and a remainder portion.

A detachable portion 14 can be a detachable swatch piece that displays traits (e.g., color, texture, reflectivity, odor, durability, ability to withstand water or other treatments, etc.) of a sample product such as a beauty product. The detachable portion 14 can have various configurations. FIG. 3 schematically illustrates a detachable portion of FIG. 1. The detachable portion 14 can include a sample portion 24, a remainder portion 22, and an accessible edge that can comprise, for example, a nail tip 20. The sample portion 24 may partially or wholly subsume or include the nail tip 20. The sample portion 24 can have a smaller surface area than the surface area of the detachable portion 14. The sample portion 24 can be configured to mount, contain, present, and/or display beauty product samples and expose the beauty products' colors or other properties (e.g., visual properties) for close inspection by a consumer. Each sample portion can be configured to protrude outward, away from the product shelving and into the consumer space to allow consumers to interact with the sample portion and closely evaluate the color or other visual property. The remainder portion 22 can comprise the remaining surface area in the detachable portion 14 outside of the sample portion 24. The remainder portion can include, for example visible surface area configured to provide information to a user about the color visible from the sample portion 24. The nail tip 20 can be located generally near or along the edge of the detachable portion 14.

The detachable portion 14 can have a shape that is convenient to grasp and handle when it is being attached and/or detached. It can provide a balance between visual space around the color and efficient use of the rack length. It can also provide a balance between efficient use of substrate materials and robust physical strength to allow for repeated use, repeated attachment and detachment, and potential events such as repeated dropping onto a hard surface. The shape schematically illustrated here is a substantially square shape. The sample portion 24 can generally be shaped and sized to resemble a fingernail or a toenail. The remainder portion 22 can be connected to the sample portion 24 by surrounding the sample portion 24 along at least a part of the periphery of the sample portion 24.

Figure 4E:
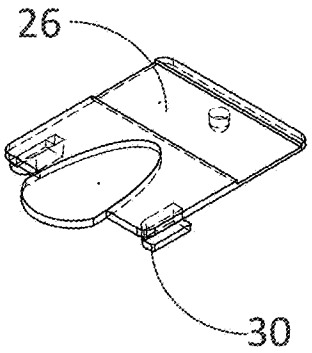
FIGS. 4A-4E illustrate various views of an example shape for the detachable portion/swatch piece schematically shown in FIG. 3, with additional features shown.
Figure 4D:
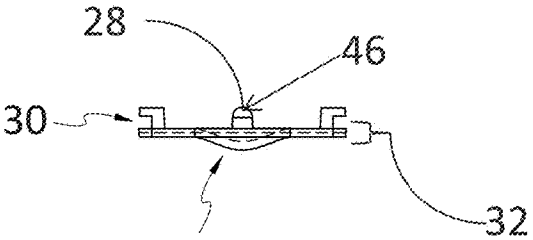
Figure 4A:
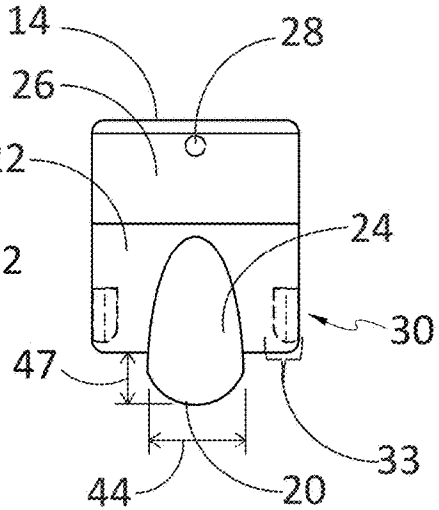
Figure 4C:
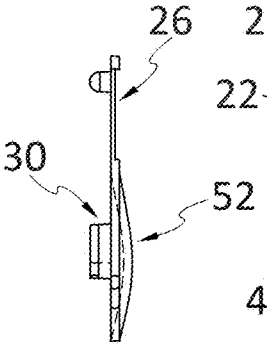
Figure 4B:
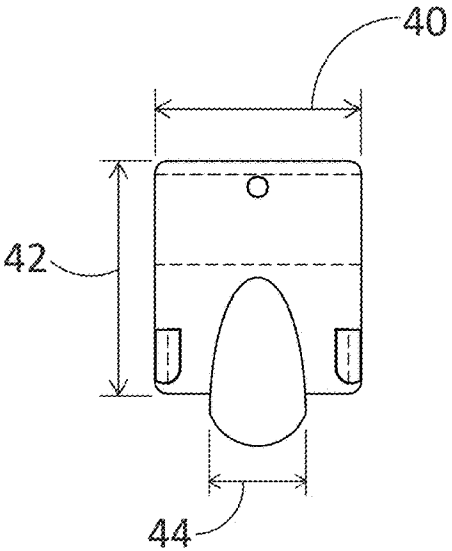

FIGS. 4A-4E (collectively, FIG. 4) illustrate various views of an example shape for the detachable portion 14 schematically shown in FIGS. 1-3, with additional features shown. FIG. 4A is an elevational view of the superior surface, FIG. 4B is an elevational view of the anterior surface, FIG. 4C is a side view along a horizontal axis, FIG. 4D is a side view along a vertical axis, and FIG. 4E is a perspective view. The detachable portion 14 can have a sample portion 24 and a remainder portion 22. The sample portion 24 can have a nail shape, and a thick layer 32. The remainder portion 22 can have a button 28, a label portion 26, and sliding slots 30. The sliding slots can have a width 33. The button 28 is an example of a slot engagement protrusion and/or channel interface feature. The detachable portion 14 can be generally in a shape of a square, with a substantially similar vertical length 42 and horizontal length 40. The sample portion 24 can be of a nail shape, having a maximum horizontal length 44 and a nail tip 20. The nail tip can be the leading edge of a protrusion from the detachable portion 14. In some useful configurations, the protruding length 47 of the detachable portion 14 can be about 0.1 or 0.2 inches to about 0.5 or 0.3 inches. The maximum horizontal length 44 is the length where the nail shape of the sample portion 24 is the widest and is relevant if, as illustrated, the nail shape is generally tapered. The nail tip 20 can comprise a curve that protrudes outside of the generally square shape of the detachable portion 14, as shown.

The sample portion 24 can be aligned to the edge of the detachable portion 14 to form a nail tip 20. The nail tip 20 can have a curve shape corresponding to an average person's cuticle located at the base of a finger or toe nail, for example. The sample portion 24 can have a superior concave surface and a corresponding anterior convex surface, and can be distinguished from the remainder portion 22 which can have a generally flat surface. A superior concave surface can be configured to generally cover a human finger or toe nail, for example, and below it on the anterior surface, a convex surface can allow the human finger or toe nail to nest immediately adjacent thereto, such that the sample portion can appear temporarily to take the place of a consumer's own fingernail, giving them the sense of what it would look like to purchase and apply the relevant beauty product (e.g., nail colorant, in this example). The sample portion can be sized to correspond to an average fingernail or toenail shape. It can be particularly advantageous for a person to be able to hold a fingernail or toenail adjacent to the sample portion 24 in order to evaluate what that color would look like if applied to that person's fingernail or toenail. Fingernail polish can be applied directly to either the superior or anterior surface of a sample portion 24. If the color is applied to an anterior surface of a transparent but shiny plastic material, the sample portion 24 can further provide that person with an idea of how the color would appear when a clear coat of material is applied above it. A curved surface 52 of a sample portion 24 can allow a user to view the nail polish as it would be applied to a nail, which has a generally curved surface. If nail polish is applied to the concave surface and the detachable portion 14 or the sample portion 24 is made from transparent plastic, a user can see the nail polish through a glossy "coating" of transparent plastic material from the convex surface 52 of the sample portion 24.

The button 28 can be located in the upper middle part of the remainder portion 22, away from the sample portion 24. As seen in FIGS. 4C and 4D, the button 28 can protrude in the opposite direction of the convex of the surface of the sample portion 24. The label portion 26 can be a rectangular shape, as seen in FIG. 4, and located above the sample portion 24 on the upper part of the remainder portion 22. The button 28 can be in a shape of a rounded protrusion, as evident in FIGS. 4C and 4D, for example. However, instead of having a flatter or more blunted tip, the button 28 can have a sharper peak 46. One advantage, among others, of the button 28 having a relatively sharp peak 46, as shown, is that it can allow the detachable portion 14 to mate with and slide into a buttonhole 144 (see FIG. 5). A blunt tip, on the other hand, may be more likely to slide past a buttonhole and require the user to make additional adjustments instead of allowing the detachable portion 14 to seamlessly mate therewith.

The label portion 26 can be used to apply a sticker. A sticker label can allow a user to identify the nail polish, for example, by listing the name, brand, or serial number of the nail polish applied on the sample portion 24. A user may conveniently look at the label sticker on the label portion 26, instead of having to guess how a particular color or brand of nail polish can look like once applied to nails. As seen in FIGS. 4C and 4E, the surface of the label portion 26 can be carved inward, sunken, or recessed from the surface line of the remainder portion 22, so that a label sticker with similar dimensions can be pasted or otherwise affixed therein on the detachable portion 14, thereby allowing the superior surface of the label sticker to be substantially flush with the surface of the remainder portion 22.

FIG. 4 also illustrates how a detachable portion 14 can have two sliding slots 30. The sliding slots can be located along the side edges of the detachable portion 14. As seen in FIGS. 4C and 4D, the sliding slots 30 can protrude in the opposite direction of the convex of the surface of the sample portion 24. As illustrated in FIG. 4, the sliding slots 30 can be female slots projecting inward from outer edges of the detachable portion 14.

The horizontal length 40 of the detachable portion 14 can be substantially similar to the width of relevant nail polish containers. In some embodiments, a method allows a user to customize the horizontal length 40 and/or the overall length 31 of a frame 12 (see FIG. 1) and the spacing between detachable portions to allow the detachable portions to align with relevant nail polish containers that may be arranged in columns or series behind corresponding sample swatches. The horizontal length 40 of the detachable portion 14 can be longer than the horizontal length 44 of the sample portion 24, so that the sliding slots 30 having widths 33 may not be immediately adjacent to the periphery of the convex sample portion 24. For example, the horizontal length 40 of the detachable portion 14 can be 1 inch, and the horizontal length 44 of the sample portion 24 can be 0.5 inch; the width 33 of the sliding slots 30 can be 0.1 inch, and the sliding slots 30 are not adjacent to the sample portion 24. Advantageously, the longer horizontal length 40 of the detachable portion in comparison to the horizontal length 44 of the sample portion 24 allows a user to view her own skin or flesh surrounding her nail through a functional window of the detachable portion 14 and avoiding or limiting a need for viewing through the thicker, less transparent sliding slots 30. Thus, a wider detachable portion 14 can allow for better viewing opportunities. Further, by having a longer horizontal length 40, a user may advantageously grip or grasp a portion of the detachable portion 14 with a pair of fingers while detaching the detachable portion 14 from the rack 12, without having to painfully graze the fingers with parts of the slots 30 or the rack 12 when enough force is exerted to remove the detachable portion. Thus, a wider detachable portion 14 can allow for safer and more comfortable detachment.

Figure 10:
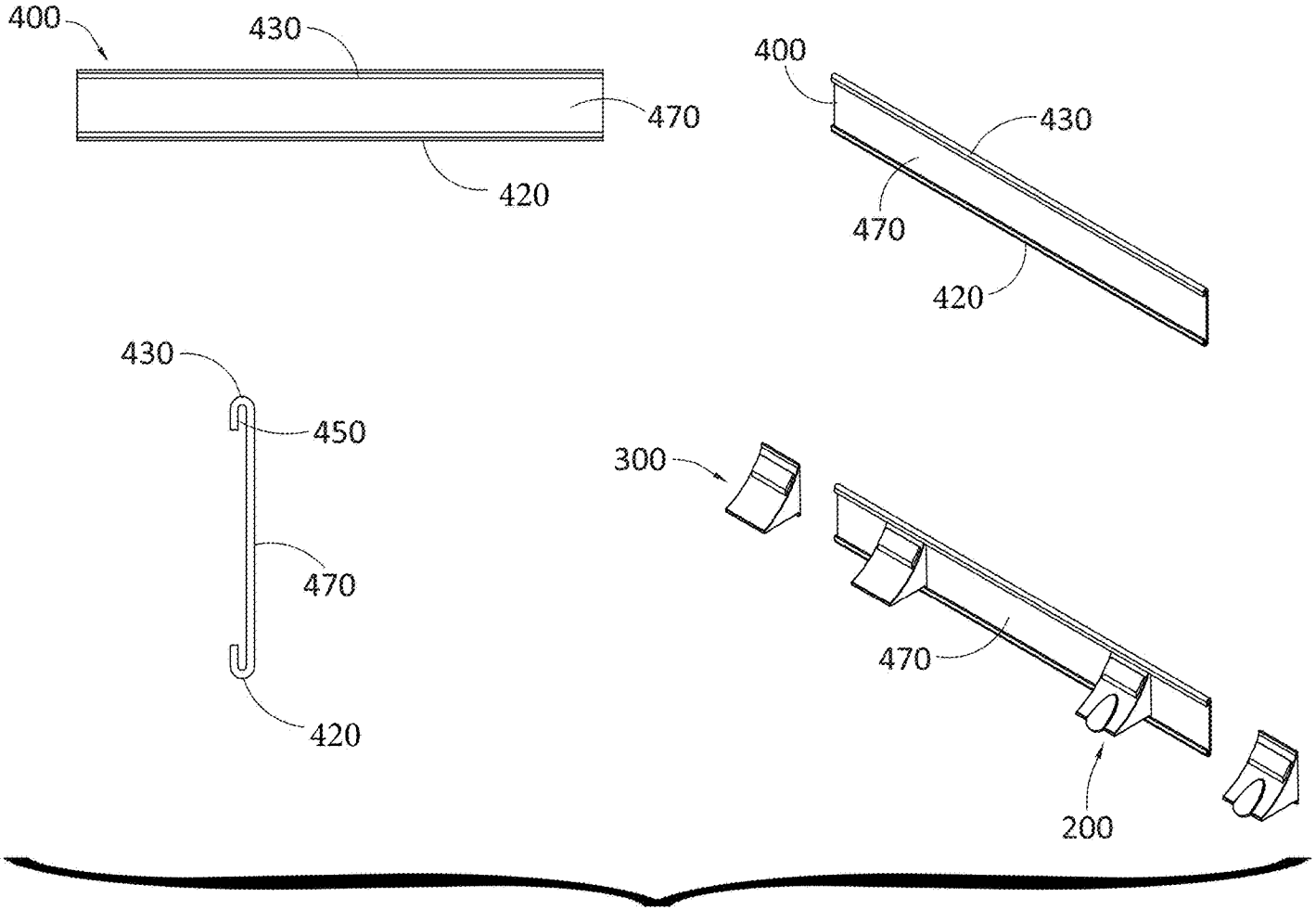
FIG. 10 illustrates various views of an example sliding channel sliding channel frame and swatch piece having rails, and how they can relate to each other.

The remainder portion 22 can have a shorter horizontal length 40 than the horizontal length 44 of the sample portion 24. For example, the horizontal length 40 of the remainder portion 22 can be 0.5 inch, and the horizontal length 44 of the sample portion 24 can be 0.7 inch. A user may be able to view the skin surrounding the nail, as the sample portion 24 and the remainder portion 22 are only connected at the end of the sample portion 24. Here, instead of using sliding slots 30, the detachable portion 14 can be attached to the frame 12 by other means, such as by using multi-use adhesives, Velcro, or mating the detachable portion 14 to a female slot in the frame 12. (An example of such a configuration is illustrated in FIG. 10). The frame can be configured for adhesion to the elongate shelving by including a strip of adhesive with a removable cover to facilitate the adhesion. The button 28 can be a buttonhole instead of a knob and can receive a knob-like structure on the frame 12, such as a hook. Here, the remainder portion 22 may also have a sliding channel to allow the knob from the frame 12 to slide through. Because the channel can also be described as a slot, the knob is an example of a slot engagement protrusion or channel interface feature. The sliding slots 30 can be male sliding slots that can be mated to female sliding slots in the frame 20. Multiple detachable portions 14 can be connected to each other so that more than one detachable portion 14 can be removed or attached to the frame 12 simultaneously.

The systems discussed herein can have different sizes and shapes. For example, the shape and size of the nail-shaped sample portion 24 can be adjusted. The nail-shaped sample portion 24 can have a shape of a person's toenails, which can be wider or narrower than a person's fingernails. Smaller nail-shaped sample portions 24 can be used for target customers with smaller fingernails, such as children. The nail-shaped sample portion 24 can have a shape of different body parts other than fingernails or toenails, such as a shape of a person's eyelids, eyelashes, etc. Such shapes of the nail-shaped sample portion 24 can be used, for example, to allow a customer to view the color of a cosmetic product use to enhance a person's eye (e.g. mascara) without having to apply the cosmetic product. The shape of the nail-shaped sample portion 24 can be adjusted for other purposes such as displaying hair color, colored contact lenses, make-up, tattoo, tooth coloring, etc.

In addition to or in place of the button and button-hole structures described, other attachment features can also be used. For example, various mechanisms can controllably allow, or inhibit the movement of the detachable portion 14. These include some or all of the following, alone or in combination: studs, locks, plugs, clips, pins, latches, fasteners, etc.

Materials

The frame 12 and/or the detachable portion 14 can be formed from transparent plastic or other materials and can include a transparent coating. The transparency of the material can provide enhanced cosmetic (e.g., glossy) effects and other practical advantages discussed further below. The product shelving tray 110 in FIGS. 7A-7D can be made of plastic, such as acrylonitrile butadiene styrene or acrylic. The frame 12 and/or the detachable portion 14 can be formed from non-transparent plastic or other materials with a non-transparent coating. For example, a white, transparent, translucent, black, gray, off-white, tan coating and/or substrate can be used.

Clear plastic can be used for at least a portion of the detachable portion (such as the remainder portion 122 of FIG. 4, for example). This allows users to see the flesh surrounding the nail, behind the detachable portion 14. Clear plastic can also be used to permit the user to see through the plastic material to a printed insert or printed backing. Transparent, translucent, or partially transparent plastic can be used to form any of the various portions illustrated in FIG. 1, including the frame 12, and the detachable portion 14. Preferably, the detachable portion 14 is formed from transparent plastic so the flesh surrounding the nails can be seen through it. The frame 12 can be in front of the detachable portion 14 so a part of the detachable portion 14 is covered by the frame 12. In this case, at least a portion of the frame 12 is advantageously transparent to reveal the detachable portion 14 through the front of the frame 12. The detachable portion 14 can be in the front of the frame 12.

Whether the various portions are transparent or not, however, it can be desirable to be able to print on those portions, even if they are formed from plastic. Printing directly on plastic, clear or otherwise, has many advantages. Such an approach can avoid extra costs associated with extra inserts, for example. Furthermore, printing on clear plastic allows for a wide array of impressive visual effects. Plastic materials that can be used for these purposes include thermoplastic materials.

Materials can include plastic materials that resist breakage, brittle fracturing, bending, tearing, puncturing, and/or ripping. Further, materials can be chemically resistant and may not react with nail polish. Preferred materials include acrylics, polymethyl methacrylate, methacrylates, methyl acrylate, ethyl acrylate, 2-chloroethyl vinyl ether, 2-ethylhexyl acrylate, hydroxyethyl methacrylate, butyl acrylate, butyl methacrylate, TMPTA, acrylonitrile butadiene styrene, polyvinyl chloride (PVC), polyethylene (PET), recycled PET, recycled PVC, polypropylene, PVC styrene, APET, recyclable PET, recyclable PVC, and other materials having similar tamper and chemical resistance. Various disclosures described herein are formed from a wide variety of virgin, recycled, or recyclable materials, providing a unique appearance that is both superior in quality and environmentally favorable. The plastic material can be completely transparent, partially transparent, or fully impervious to light. Varying levels of opacity can be accomplished by printing ink layers on the surfaces of the plastic material or by including opaque materials in the mixture of chemicals that is used to form the original plastic material, for example. A plastic display can comprise a transparent cover and a non-transparent backing, or a transparent backing and a non-transparent cover. Various other combinations of transparency and/or opacity are also possible.

Some or all of the portions of the package described as "plastic" can be formed from a mineral-based material. For example, one material that can be used to form non-transparent portions of a rack or a detachable portion, including without limitation, the front or back portions, is "ViaStone" or "NatureStone." Mineral-based materials can be made with natural stone, such as limestone, although other minerals can also be used. Mineral-based materials can also be made with inorganic mineral powder and can have reduced resin content. These materials often require less bleaching than many tree-based paper products. The production of ViaStone, for example, is generally tree-free and often does not require water or toxic agents. Other stone-based papers can include Terraskin, Xterrane, and Ultragreen. Limestone-based papers can be referred to generically as "limestone mineral paper," or "LMP."

The term "plastic", as used throughout this specification, is used broadly to include the bio- and mineral-based materials described above, and does not refer exclusively to petroleum-based products.

Frame

Figure 5:
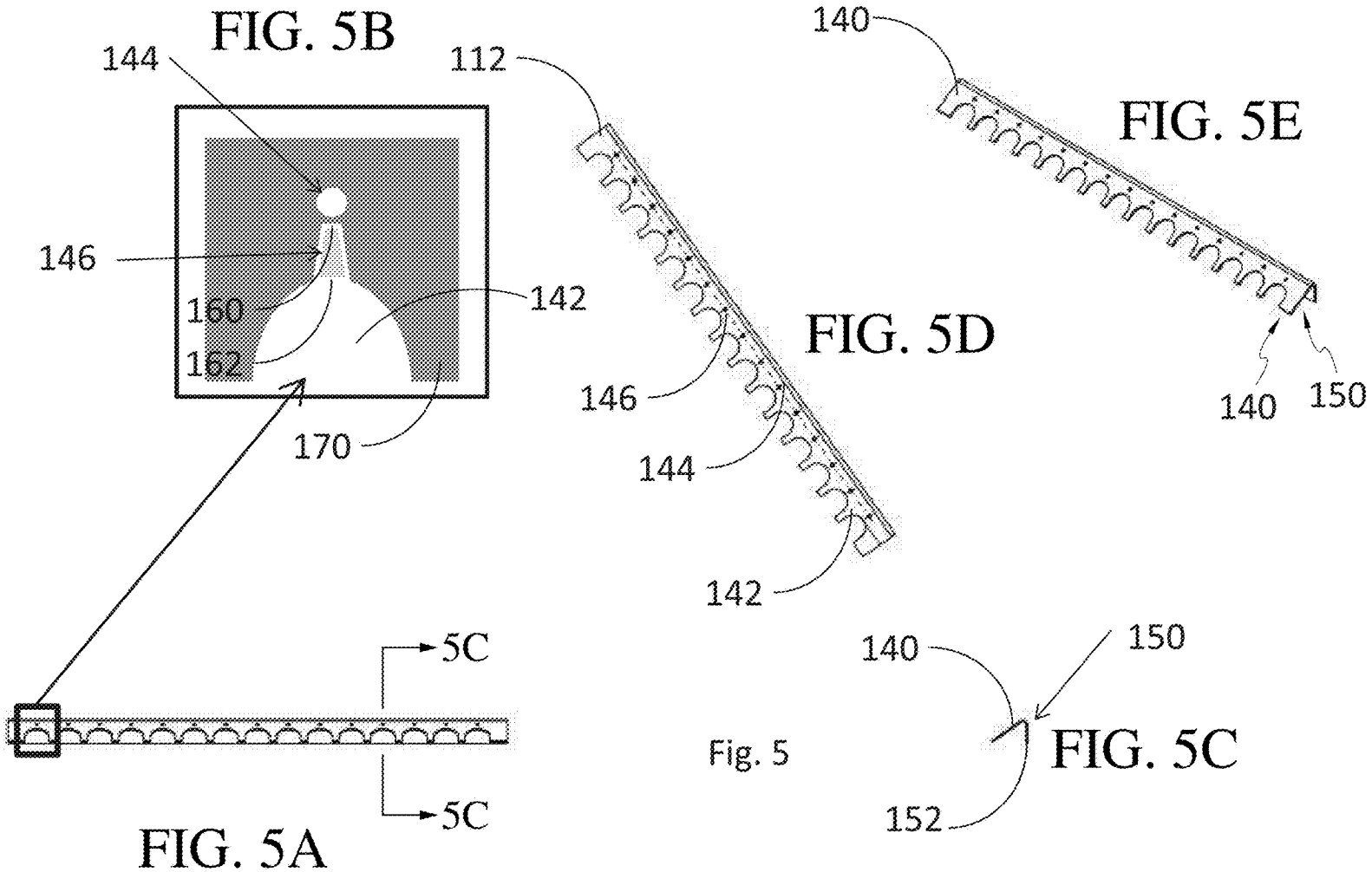
FIGS. 5 A-5E illustrate various views of an example shape for the frame schematically shown in FIG. 1, with additional features shown.

FIGS. 5A-5E (collectively, FIG. 5) illustrate various views of an example shape for the frame schematically shown in FIG. 1, with additional features shown. FIG. 5A is a view of the frame as it would be seen laying on a flat surface. FIG. 5B shows a detail view of a portion of FIG. 5A, as indicated. FIG. 5C is a cross-section view of a section taken along the lines 5C-5C of FIG. 5A. FIG. 5D is an elevational view. FIG. 5E is a perspective view. As seen in both FIGS. 5C and 5E, the frame 112 can include a hanging portion 150 and an attaching portion 140. The hanging portion 150 can have a smooth tip 152. The attaching portion 140 can include buttonholes 144, button channels 146, arch cut-outs 142, and arch legs 170.

As seen in FIGS. 5C and 5E, the hanging portion 150 and the attaching portion 140 can be connected at an angle, forming an L-like shape of the frame 112 when viewed from the side. When the frame 112 is placed on a flat surface, the attaching portion 140 may become an inclined plane, while the plane of the hanging portion 150 may be substantially perpendicular to the flat surface. The arch cut-outs 142 can be formed in the attaching portion 140 and their arch shape can cut in toward the hanging portion 150. The buttonholes 144 can be circular in shape, and each can be a depression or a hole that pierces partially or completely through the surface of the attaching portion 140 near the apex of each arch cut-out 142. The button channels 146 can be elongate, generally tapered, having a trapezoidal shape, with shorter base 160 being closer to the button 144 than longer base 162. For example, the shorter base 160 can be 0.01 inch wide, and the longer base can be 0.05 inch wide. In this illustration, the button channels 146 are not connected to the buttonhole 144, so that the shorter base 160 does not abut the buttonhole 144. The button channels 146 can each comprise a groove that is formed in the surface of the attaching portion 140 from the edge of the arch cut-out 142 toward the buttonhole 144. The buttonholes 144 and the button channels 146 are placed along the centerline of the arch cut-out 142 above the arch cut-out 142, the buttonholes 144 being farther away from the arch cut-out 142 than the button channels 146. Here, the buttonholes 144 and the button channels 146 together generally form a shape of a key hole when viewed from above the surface of the attaching portion 140.

The hanging portion 150 can be sized and shaped for insertion into a corresponding slot in product shelving. Even if a customized slot is not present, the hanging portion 150 can be held in place by a product tray or by products themselves that slide down toward the consumer space under the force of gravity in many angled shelving systems. The hanging portion 150 can be attached to or hang on a lip of a larger, substantially immobile object, such as product shelving, so that the frame 112 can be substantially durable and/or relatively permanent, while detachable portions 114 are replaced as new products and/or colors come and go over time. The frame 112 can resemble a hand or feet, or fingers and toes, so that the detachable portions 114 can attach to a rack 112 that resembles a human body part.

Frame and Detachable Portion

Figure 6A:
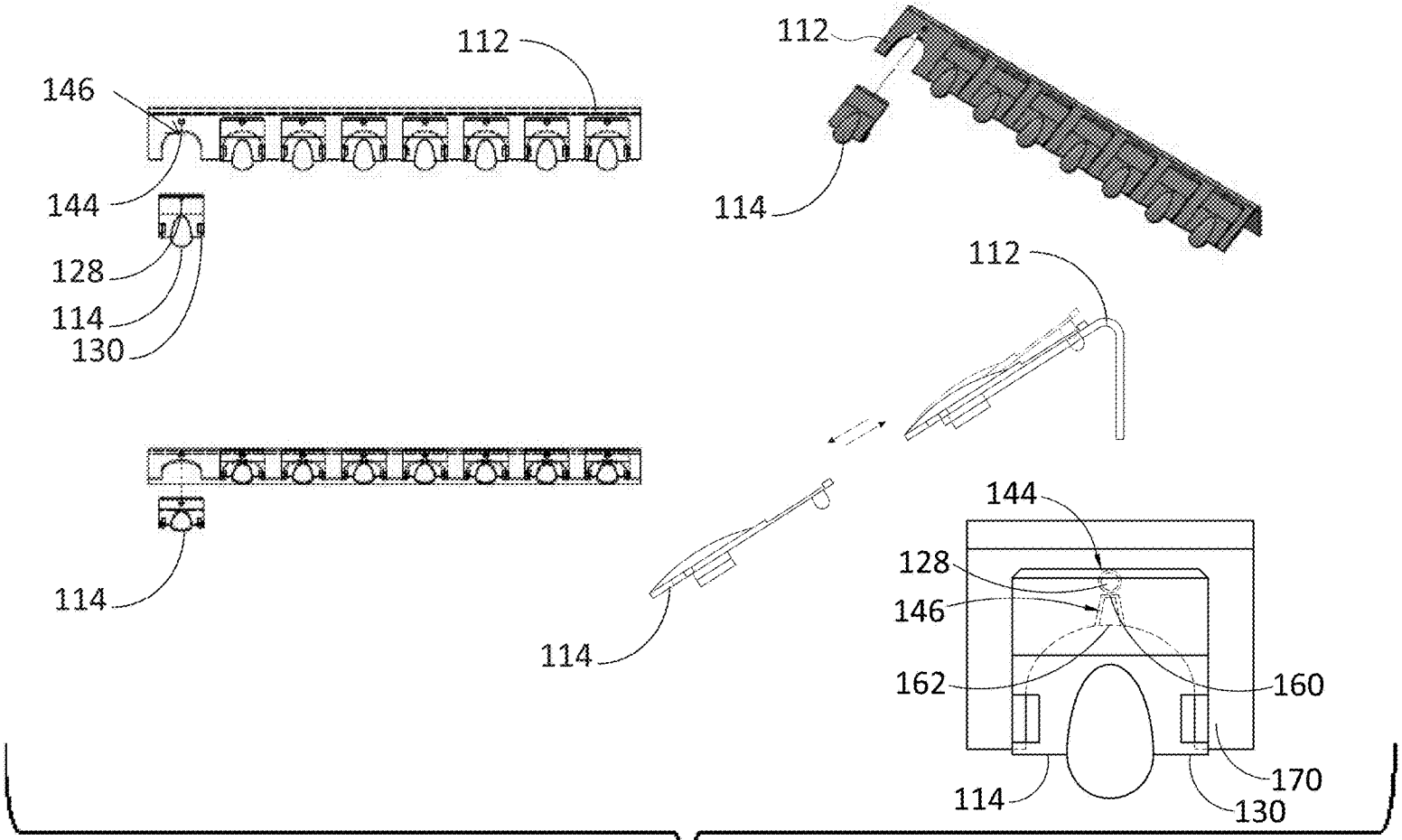
FIGS. 6A-6B illustrate various views of an example sample display system with a swatch piece.
Figure 6B:
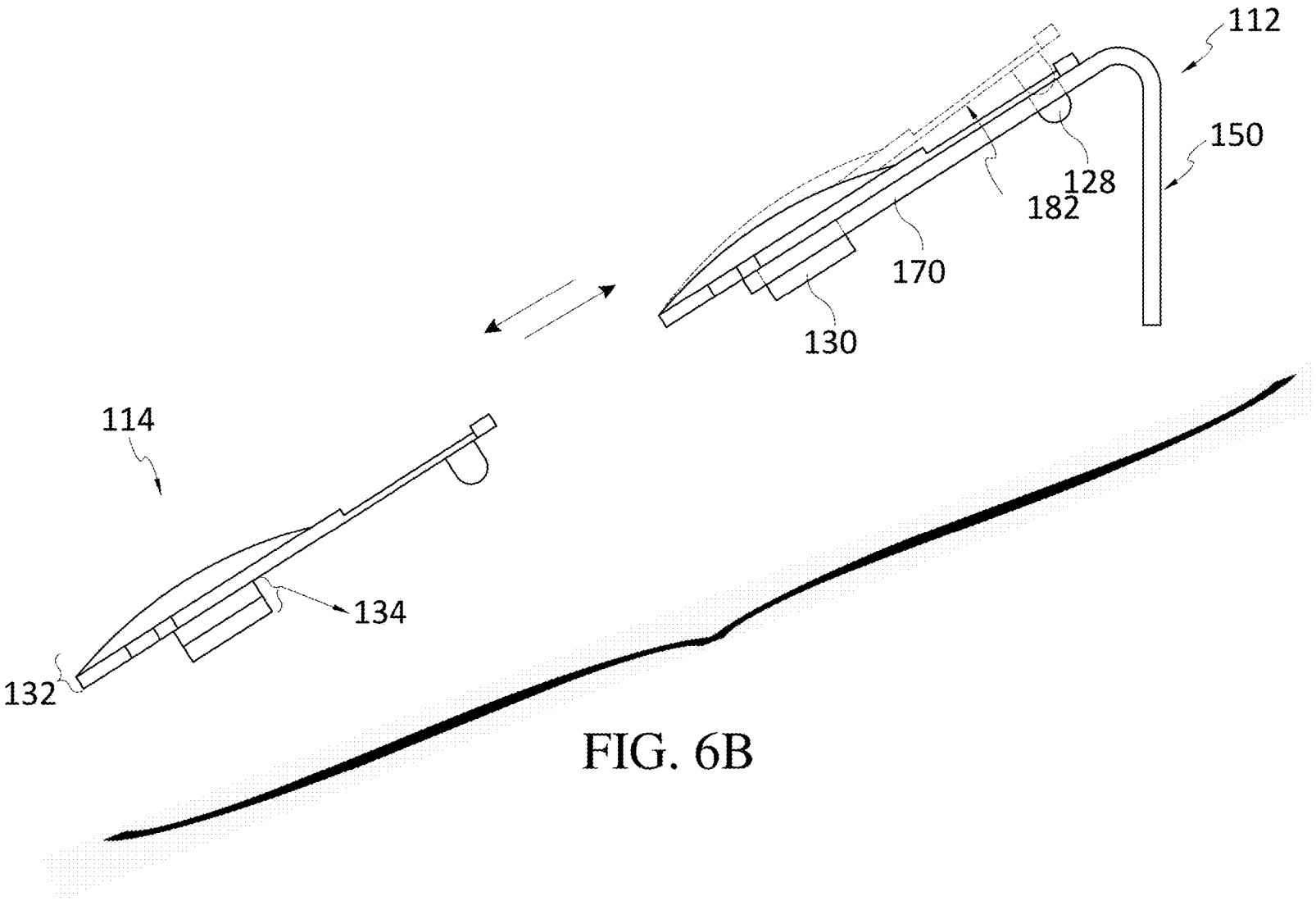

FIGS. 6A-6B illustrate various views of an example sample display system with a detachable portion. The frame 112 can be a frame configured to releasably accept detachable portions. The detachable portion can be a sample display. The arch legs 170 can be apart from one another at a substantially similar distance as the width of the detachable portion 114. The detachable portion 114 has a thick layer 132. The sliding slots 130 have a thick layer 134. The frame 112 can include a hanging portion 150 and an attaching portion 140. The hanging portion 150 has a smooth tip 152. The attaching portion 140 can include buttonholes 144, button channels 146, arch cut-outs 142, and arch legs 170.

In operation, as shown in FIG. 6A, a button 128 of the detachable portion 114 may enter the channel 146 from the direction of the channel's longer base 162 and move along the channel 146 toward the buttonhole 144. As the button 128 is moved through and past the shorter base 160 of the channel 146, the button 128 can slide down into and nest or lock into the buttonhole 144. As the button 128 slides through the channel 146, the arch legs 170 enter the sliding slots 130 of the detachable portion 114. Ultimately, when the button 128 enters the buttonhole 144, the sliding slots 130 may mate to the arch legs 170 so that the detachable portion 114 is stably positioned within the attaching portion 140.

As seen in FIG. 6B, when the detachable portion 114 is being slid onto the rack 112, the button 128 can cause the detachable portion 114 to partially lift up, while the rest of the detachable portion 114 is held down by the sliding slots 130 mated to the arch legs 170. This can cause the detachable portion 114 to experience a torsion force that can slightly bend the detachable portion 114. Similarly, the sliding slots 130 can experience a torsion force that can slightly bend the sliding slots 130. The thick layer 132 of the detachable portion and the thick layer 134 of the sliding slots can advantageously withstand the torsion force and resist fracture or breakage. Once the button 128 enters the buttonhole 144, the torsion force will no longer bend the detachable portion 114 and the detachable portion 114 may return to its original shape. When the button 128 is locked in the buttonhole 144, the sliding slots 130 mated to the arch legs 170 can secure the detachable portion 114 to the frame 112.

The frame 112 can have a retention mechanism comprising a buttonhole 144 and a channel 146. The channel can have a wider entrance (see longer base 162) and a narrower exit (see shorter base 160), and a ridge between the shorter base 160 and the buttonhole 114. The channel 146 can be configured such that the width of the entrance or longer base 162 can be wider, thereby allowing a button 128 to be more easily accepted and entrained. The channel 146 can narrow along its length, thereby aiming a button 128 toward a button hole 144. Nevertheless, a ridge can be provided between the channel 146 and the button whole 144 so that the button 128 slides up and over the ridge before seating in the button hole 144. As shown in FIG. 6B, the retention mechanism of the detachable portion 114 is configured such that when the button 128 is moved in the channel 146 from the longer base 162 past the ridge 160 toward the buttonhole 144, such movement causes the detachable portion 114 to experience a torsional force, e.g., to deflect away from the frame 112. The torsional force experienced by the detachable portion 114 can be less than a torsional force experienced by a detachable portion 114 used with a frame 112 lacking a retention mechanism 116. The maximal torsional stress is experienced for a limited duration by the detachable portion 114 shown in FIG. 6B when the button 128 is being pushed past the ridge 160. In comparison, a frame 112 without a retention mechanism may experience the maximal torsional stress along the traveling path of the button 128 constantly throughout insertion and removal of the detachable portion 114, which may fatigue the detachable portion 114 and the rack 112 and result in limited lifespan.

The retention mechanism can be of different configurations. For example, the buttonhole 144 can be a recess or a latch. The channel 146 can have a constant width. Other adjustments can be made to the retention mechanism to reduce the overall torsional stress. A retention mechanism can comprise features illustrated in FIG. 10, such as rail portions 230, 232 that may be configured to slidably fit within track slots 450 of a sliding channel frame 400. The rail portions are examples of slot engagement protrusions or channel interface features. Many retention mechanisms include mechanical features on a more permanent rail, frame, or scaffold, along with complementary mechanical features on a more mobile sample portion.

When detaching the detachable portion 114 from the frame 112, a user may grip or grasp the detachable portion 114 with fingers. The hanging portion 150 can be attached to a larger, substantially immobile object, such as product shelving. The user can hold the hanging portion 150 of the frame 112 with one hand. The hanging portion 150 advantageously has a smooth tip 152, so that it won't cut or cause pain to the user's hand. While the hanging portion 150 is held firm by a hand or a larger, substantially immobile object, such as product shelving, a user may exert force at or in the direction of 182 (e.g., by pressing the detachable portion 114 from underneath the detachable portion 114) so that the button 128 may be lifted up and out of the buttonhole 144. Pressing 182 the detachable portion 114 from underneath can apply a torsion force on the detachable portion 114, so that the detachable portion 114 may be slightly bent, while parts of the detachable portion 114 are held down by the sliding slots 130. The user can slide the detachable portion 114 away from the rack once the button 128 is no longer seated within the buttonhole 144 (that is, when the complementary pieces are in a substantially unlocked position). The button 128 can then reenter the shorter base 160 of the channel 146. The user may slide the detachable portion 114 away from the rack, by passing the button 128 along the channel 146 through the longer base 162 of the channel 146, and release the swatch piece 100 from the frame 112. The user can place the released swatch piece 100 above the body part on which the sample product may be applied, to view how the sample would look without actually having to apply the sample.

The detachable portion 114 can be attached to the frame 112 by sliding the detachable portion 114 from the side or from above, rather than from underneath the frame 112 as described herein. The frame 112 can be part of a substantially immobile object, such as product shelving. The frame 112 and the detachable portion 114 can remain connected loosely—even when the detachable portion 114 is not snuggly attached—for example by ends of a string. Multiple frames 112 can be connected in a row. This can allow for a greater number of detachable portions 114 as well. The frames 112 can have a customizable length. The frame 112 can have a vertical length that can be substantially longer than the vertical length of the detachable portion 114. Multiple detachable portions 114 can be attached 116 to the frame 112 in a single elongate row. Multiple frames 112 can be positioned in a single elongate row. Such frames 112 positioned in a single elongate row may be substantially independent from each other or connected to each other.

Snap-Fit Configurations

The detachable portion 114 and the frame 112 can have a snap-fit configuration. A button 128 of the detachable portion 114 may have a sharp tip, such that the button 128 snaps into the buttonhole 144. A button 128 can be a flange, and can limit planar motion of the detachable portion 114. A button 128 can have a bifurcating tip that can expand when placed through the buttonhole. A button 128 can have radial threads. The area surrounding the buttonhole 144 can have a shape and/or a thickness configured to reciprocate the shape and size of the button 128. For example, the area surrounding the buttonhole 144 can have reciprocal threads that reciprocate the shape and size of the radially threaded button 128.

Two or more buttons 128 can be used in a single detachable portion to improve alignment, and those buttons can be configured to be received in multiple buttonholes 144. A detachable portion 144 having two or more buttons 128 and buttonholes 144 can be used with or without sliding slots 130. For example, two or more buttons 128 having a flange shape can be used to snap on the detachable portion 144 to the frame 112 without the sliding slots 130.

All or part of the detachable portion 114 and the frame 112 can be made of fracture-resistant materials with high tolerance. For example, the button 128 and/or the area surrounding the buttonhole 144 can be made of one or more elastomeric materials.

Sample Display and Product Shelving Tray

FIGS. 7A-7D illustrate various views of a sample display system and a product shelving tray, and how they can relate to each other. A product shelving tray 110 can be configured to be placed on a flat surface (e.g., of existing product shelving) or to hang from a frame and, along with additional trays 110, form the product shelving. The product shelving tray 110 can be sized to fit and/or couple with a frame 112. The product shelving can have elongate columns 104, which can correspond to columns for receiving beauty products, and a display edge 102. Product shelving tray elongate columns 104 can be separated by elongate column walls 106. The elongate columns 104 can also comprise one or more ribs 108 that protrude slightly from the floor of each column 104 to facilitate sliding and reduce friction. The product shelving tray 110 may be configured to house, arrange, and display for purchase one or more nail polish containers 100. Nail polish bottles can be arranged in series, where each elongate column 104 contains a series with multiple bottles of the same color of nail polish. As noted above and also illustrated here, the frame 112 can include a hanging portion 150 and an attaching portion 140. The hanging portion 150 can have a smooth tip 152. The attaching portion 140 may have arch legs 170.

Figure 7A:
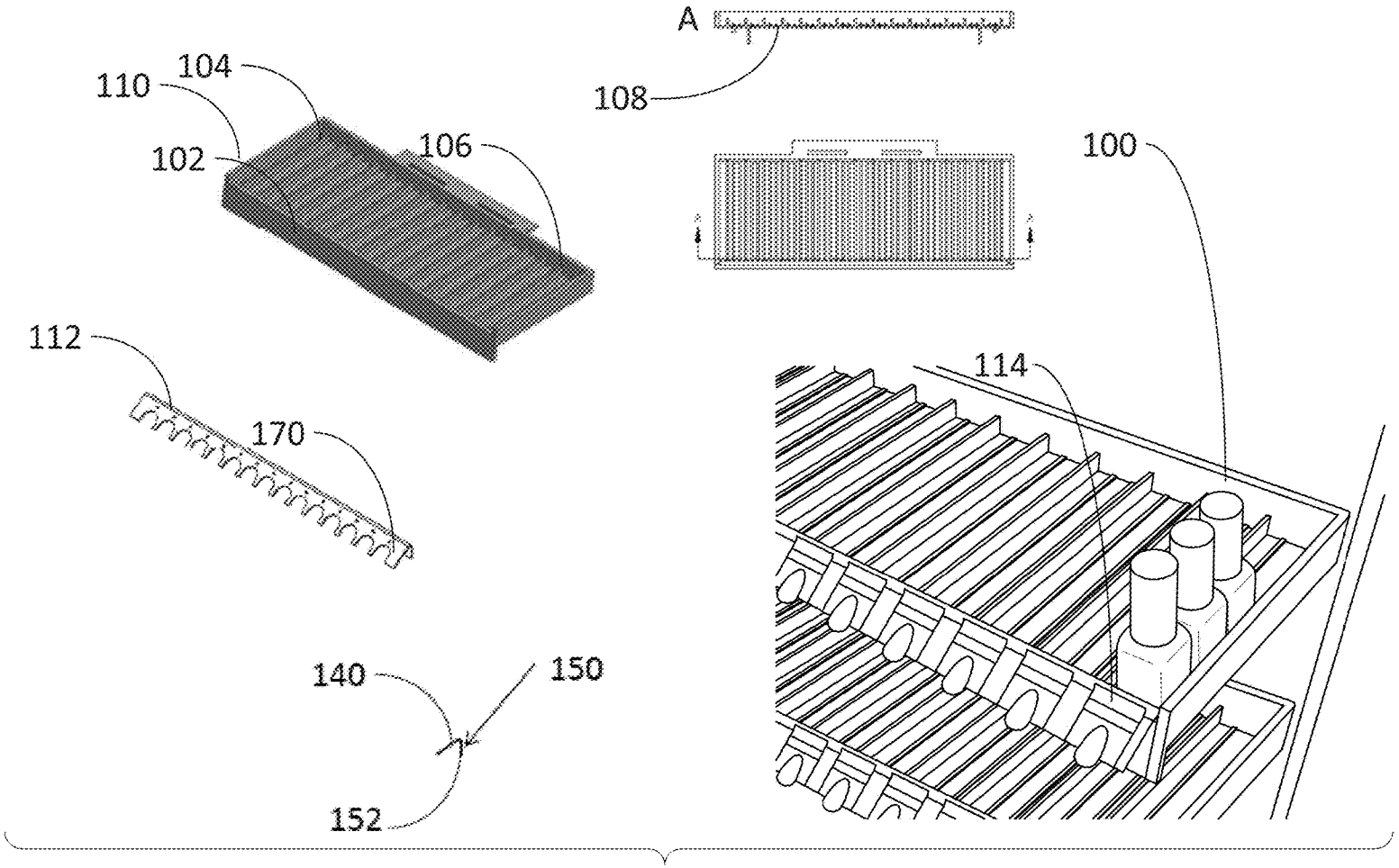
FIGS. 7A-7D illustrate various views of a sample display system and product shelving tray, and how they can relate to each other.

The hanging portion 150 of the frame 112 can hang on, attach to, or be held in place by the display edge 102 of the product shelving. Each pair of arch legs 170 of the frame 112 can have a width that can be similar to the width of each elongate column 102 of the product shelving tray 110. As seen in FIG. 7A, each elongate column 104 of product shelving can house multiple nail polish containers 100, such that each pair of the arch legs 170 can connect to a detachable portion 114 that represents the color of the nail polish placed in each elongate column 104 of the nail polish containers 100.

Figure 7B:
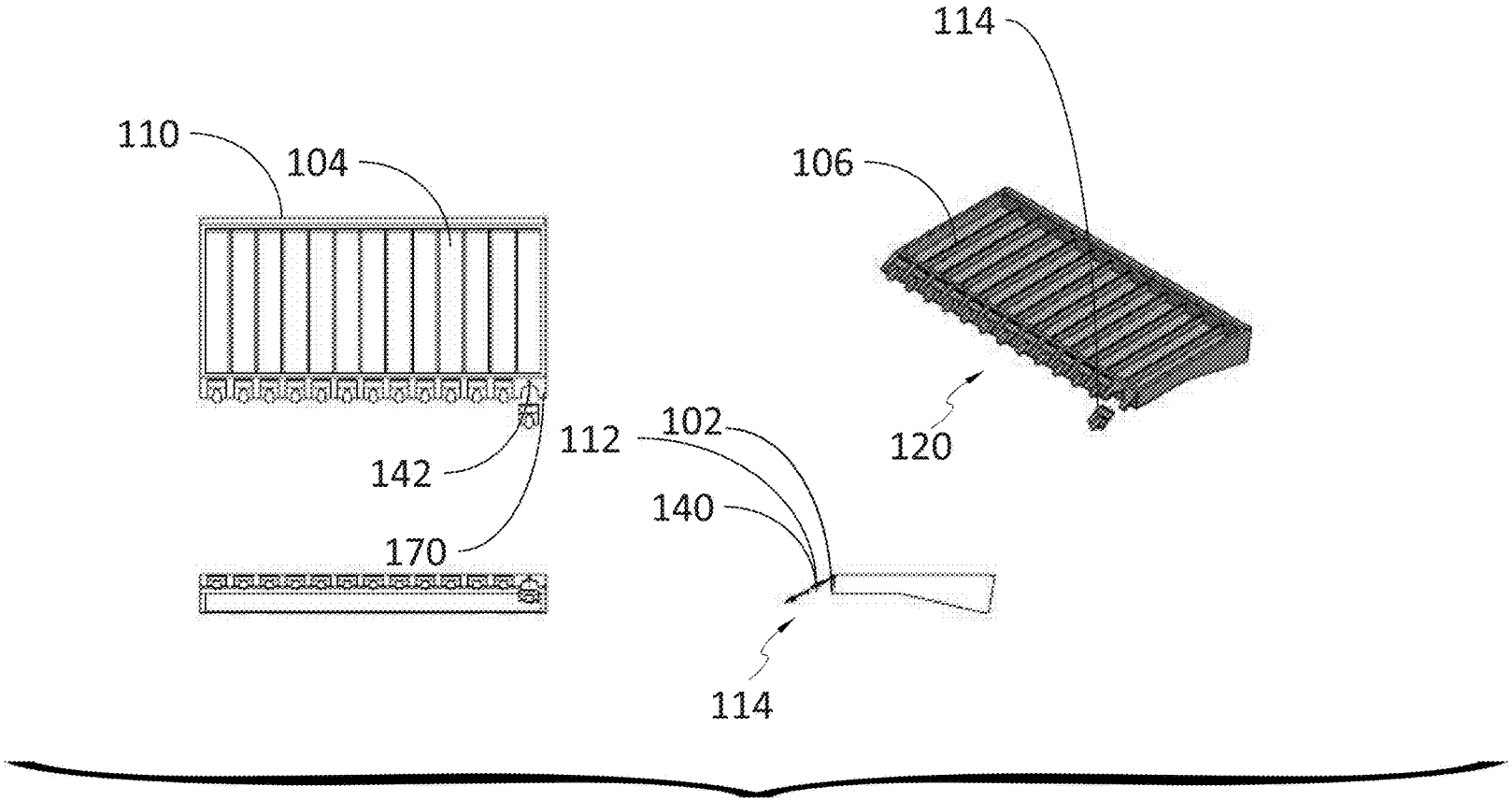
Figure 7C:
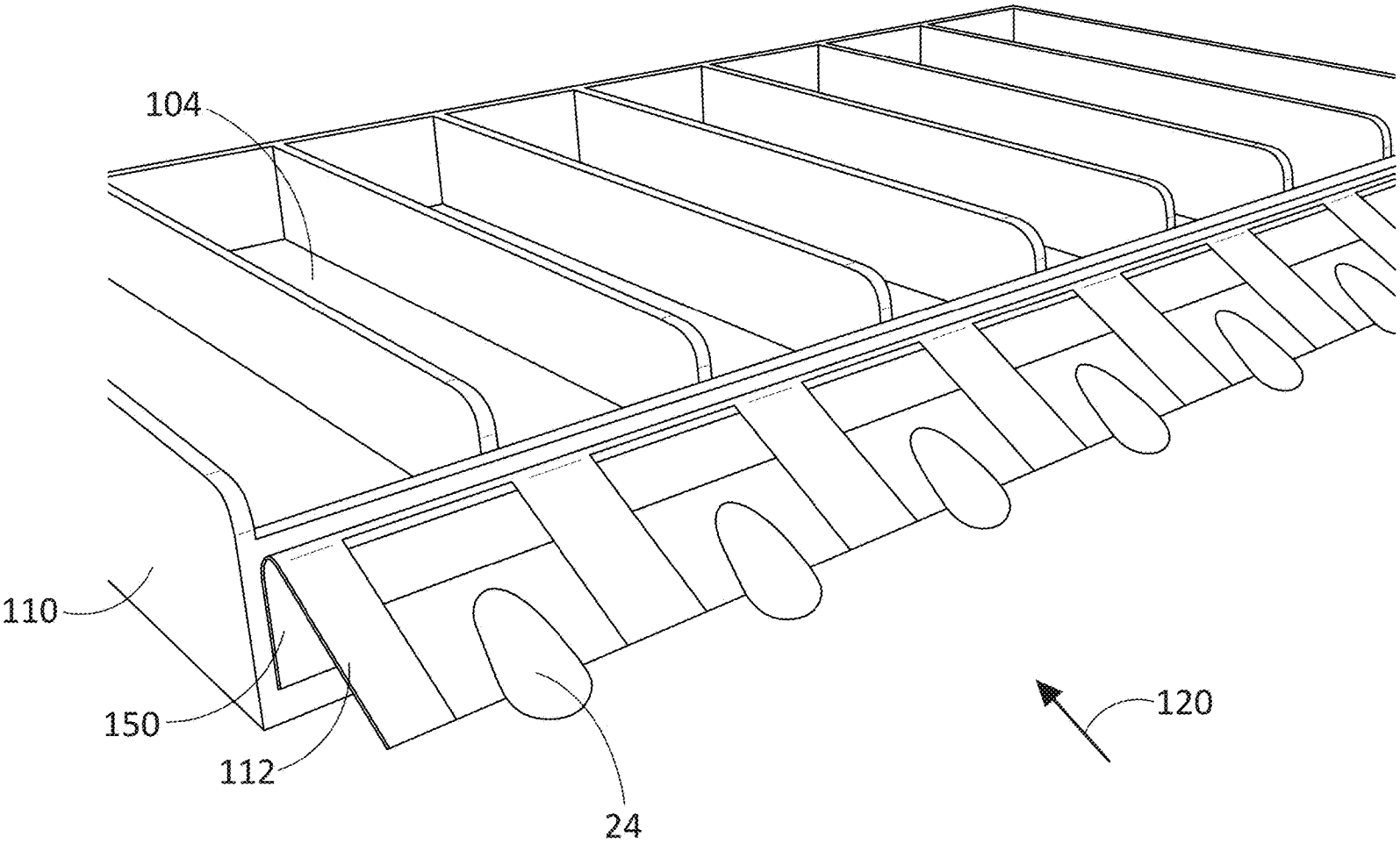

As illustrated in FIG. 7B, the product shelving tray 110 can be integrally formed to include the features described herein with respect to frame 112. Alternatively, a frame 112 can be adhered to a product shelving tray 110 as shown in FIG. 7C. The product shelving tray 110 and combined a frame 112 can have an attaching portion 140. The attaching portion 140 can be included and configured to angle away from the surface of the display edge 102. The product shelving tray 110 can include elongate columns 104. Product shelving tray elongate columns 104 can be separated by elongate column walls 106. The frame 112 can include arch cut-outs 142 and arch legs 170. One or more detachable portions 114 can be attached to each of the arch cut-outs 142 of the frame 112. Each of the detachable portions can include a sample portion 24 that can be configured to contain or display beauty product samples and expose the beauty products' colors or other visual properties for close inspection by a consumer. Each sample portion can be configured to protrude outward, away from the product shelving and into the consumer space 120 to allow consumers to interact with the sample portion and closely evaluate the color or other visual property.

The width of each product shelving tray elongate column 104 can be as wide as the width of each detachable portion 114. Each product shelving tray elongate column 104 can be evenly spaced apart by elongate column walls 106. Each detachable portion 114 can be separated by arch legs 170 of the frame 112. Each product shelving tray elongate column 104 can be aligned with a detachable portion 114. The number of elongate columns 104 in product shelving tray 110 can be equal to the number of detachable portions 114 that can be housed in the frame 112 of the product shelving tray 110.

As shown in FIG. 7C, the hanging portion 150 of the frame 112 can attach to the outside surface of the display edge 102 of the product shelving tray 110. Alternatively or additionally, a product shelving tray 110 can be configured to receive or accept sample portions that are displayed adjacent to each elongate column and that are affixed to the product shelving tray 110 itself instead of being attached to a frame 112.

Figure 7D:
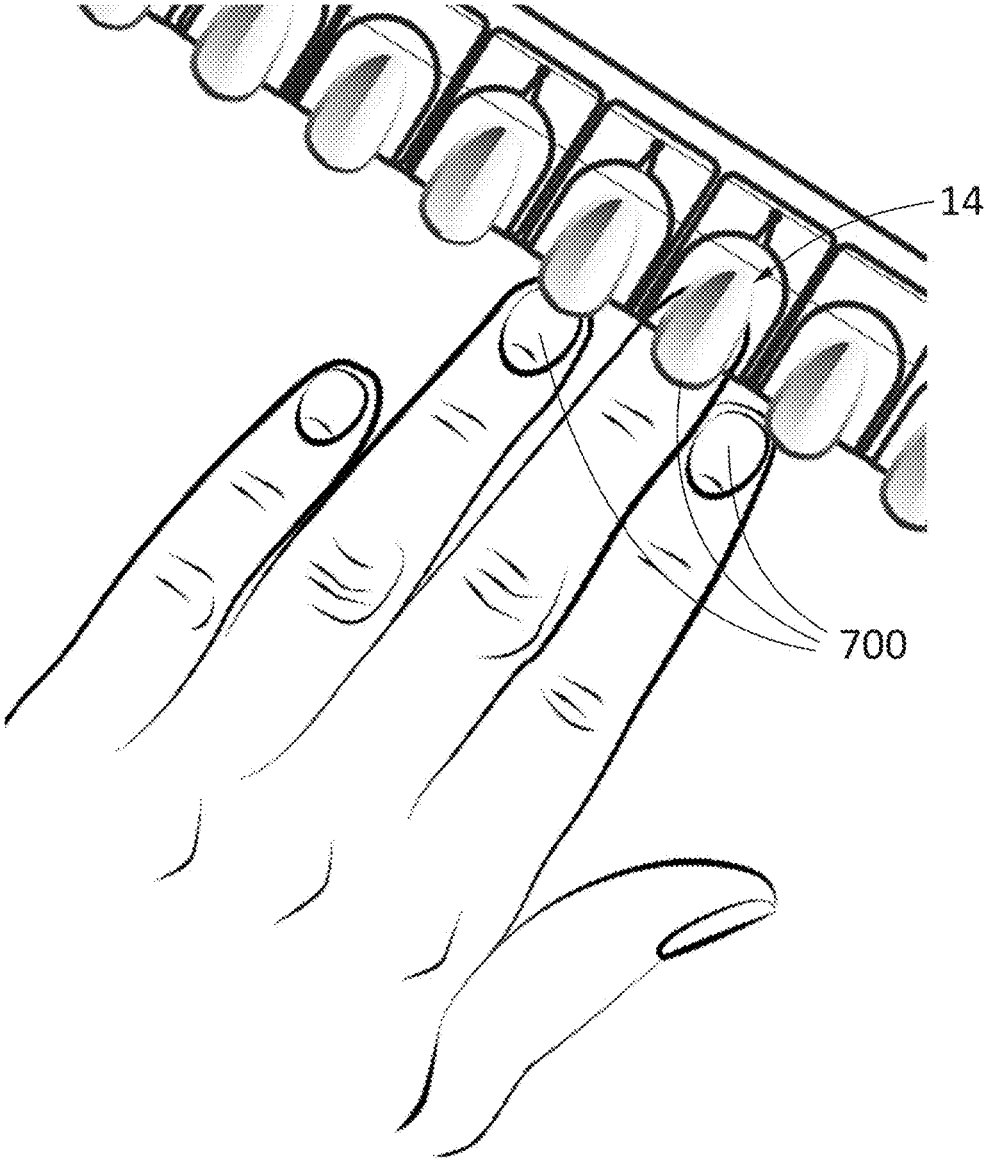

The elongate column ribs 108 can reduce the contacting surface area between nail polish containers 100 and the product shelving tray 110. This can aid in gravity fed motion of nail polish containers 100 as they slide forward and back as containers are placed in or taken out of product shelving tray elongate columns 106. A user can advantageously associate the color of the nail polish 100 in each elongate column 104 by looking at the color and the label of the detachable portion 114. By being able to associate the color or brand of the nail polish 100 and the detachable portion 114, a user can efficiently organize nail polish containers 100. As seen in FIG. 7D, a user can advantageously see the color of a nail polish by placing a fingernail 700 beneath the detachable portion 114. A user can advantageously detach the detachable portion 114 and place it above the nail to see how a nail polish inside a nail polish container 100 would look like once applied. A user can advantageously take out a nail polish container 100 for use, and return it to the product shelving tray 110 at an appropriate elongate column 104 by looking at the detachable portion 114, without having to guess the color, brand, serial number, or other identifier of the nail polish.

Swatch Piece Having Rails

Figure 8:
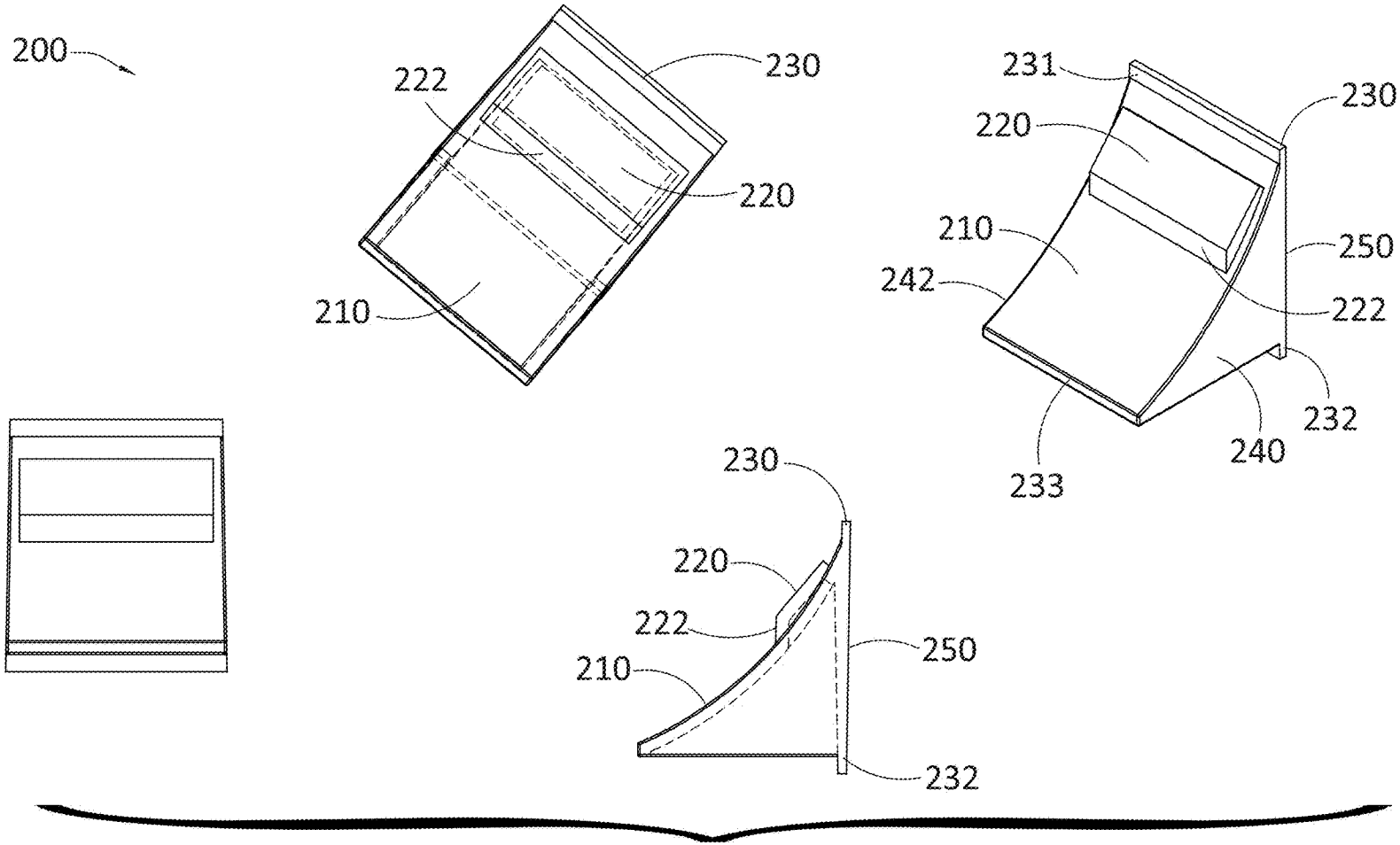
FIG. 8 illustrates various views of an example shape of a swatch piece having rails.

FIG. 8 illustrates various views of an example shape for the detachable portions 14 schematically shown in FIGS. 1-3. This example is referred to as a swatch piece having rails. The swatch piece 200 can include a sticker label portion 220, a display surface 210, a back surface 250, a first side surface 240, a second side surface 242, a top rail portion 230, and a bottom rail portion 232. The rail portions 230, 232 can be configured to slidably fit within track slots 450 of a sliding channel frame 400 shown in FIG. 10. The sticker label portion 220 can further comprise a sticker label front 222. The display surface 210 can be a sample portion that can be configured to contain or display beauty product samples and expose the beauty products' colors or other visual properties for close inspection by a consumer. The display surface 210 can include a front surface 233.

The display surface 210 can be a sloped surface having a generally rectangular shape. The surface of the display surface 210 can be curved. The first and the second side surfaces 240, 242 can be of identical shape, shaped like generally right-angled triangle. The slopes of the generally right-angled triangle shape of the side surfaces 240, 242 can be connected to the side edges of the rectangular display surface 210. The back surface 250 can be a generally rectangular surface having about the same width as the display surface 210. The height of the back surface 250 can be the same or greater than the height of the side surfaces 240, 242. The top rail portion 230 can protrude upwardly along the top edge of the display surface 210. The bottom rail portion 232 can protrude downwardly on or near the bottom of the side surfaces 240, 242. The top and bottom rail portions 230, 232 can have a thickness that can be about same as or less than the thickness of the track slots 450 shown in FIG. 10, such that the top and bottom rail portions 230, 232 may slidably but securely fit with the slots 450. In some embodiments, the back surface 250 includes the top and bottom rail portions 230, 232. In some embodiments, the curved, sloped surface of the display surface is ergonomic to complement the shape of the tip of the human figure, such that a user or a customer may be able to place a finger on the display surface.

As shown in FIG. 8, the sticker label portion 220 can be a generally rectangular protrusion, protruding away from the display surface 210. The shape and size of the sticker label portion 220 can be smaller than the shape and size of the display surface 210, such that the space that is not covered by the sticker label portion 220 comprises more than one-half of the display surface. The surface of the sticker label portion 220 can be angled such that a user or a customer may be able to view the contents on the surface of the sticker label portion 220 from above. The sticker label front 222 can be a generally rectangular surface having the same width as the width of the sticker label portion 220 that can connect the sticker label portion 220 to the display surface 210. The sticker label portion 220 can be a latch or a clip, configured to clip onto a thin object such as a piece of paper from the top. In some embodiments, the sticker label portion 220 can clip a piece of paper from the bottom.

The sticker label portion 220 can allow a user or a customer to apply a sticker that can describe the product, such as a container of nail polish, that is placed in a rack. For example, a user or a customer can removably place a coupon inside the clip shape of the sticker label portion. The rack can be the rack described above in reference to FIGS. 7A-7B. The top and bottom rail portions 230, 232 can allow a user to slide, remove and replace a swatch piece 200 with one description to a swatch piece with another description. The display surface 210 can be used to place another sticker that describes another feature of the product that is different from what is described in the sticker on the sticker label portion 220. For example, a description relating to the brush can be placed on the sticker label portion 220, while a sticker with another description relating to the color of the nail polish can be placed on the surface of the display portion 210.

Figure 9:
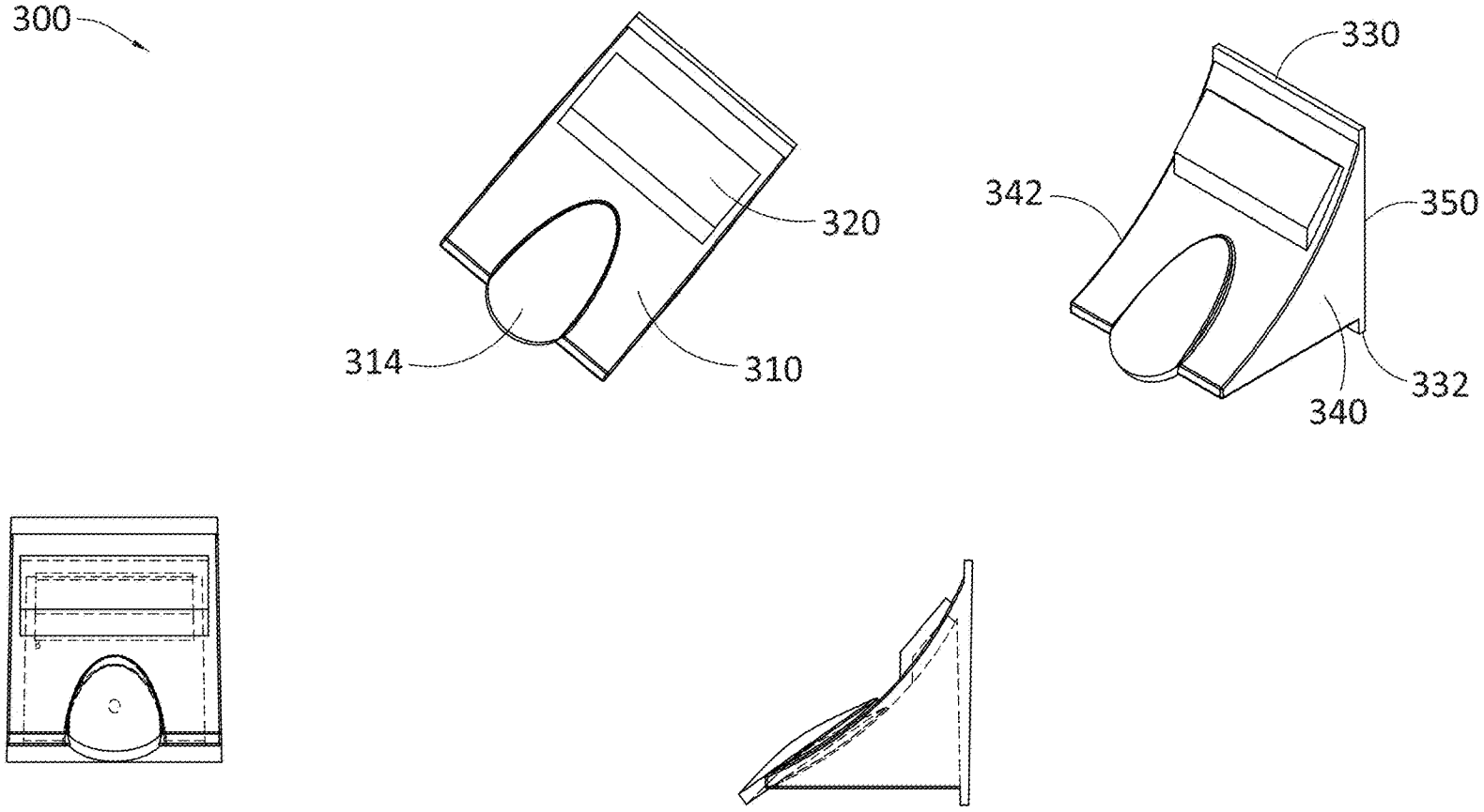
FIG. 9 illustrates various views of an example shape of a swatch piece having rails having a sample portion, a label sticker area, and a remainder portion.

The swatch piece can further comprise a sample portion. FIG. 9 illustrates a swatch piece having a sample portion. The swatch piece with sample portion 300 can include a sample portion 314, a sticker label portion 320, a display surface 310, a back surface 350, a first side surface 340, a second side surface 342, a top rail portion 330, and a bottom rail portion 332. The rail portions 330, 332 can be configured to slidably fit within track slots 450 of a display sliding frame 400 shown in FIG. 10.

The sample portion 314 can have a nail shape, such as the nail-shaped sample portion 24 described above with reference to FIG. 4. A user or customer may apply a color of a nail polish on the nail-shaped sample portion 314, such that the user or the customer is able to see the color of the nail polish in a rack placed the same column or elongate column as the swatch piece having a sample portion 300. The sticker label portion 320 can be stepped from the display surface 310. For example, the sticker label portion 320 can be a recess within the display surface 310 shaped and sized to place a label sticker. The sticker label portion 320 can protrude away and into the customer space.

The sample portion 314 can be used to display traits of other cosmetic products. For example, the swatch piece can be a hair color swatch piece 202. The hair color swatch piece 202 can have a hair display portion 212 which shows color and/or texture of hair. The swatch piece can be a skin color swatch piece 204. The skin color swatch piece 204 can have a skin display portion 214 which shows color and/or texture of skin.

Sliding Channel

FIG. 10 illustrates various views of a display sliding channel and display swatches, and how they can relate to each other. The display sliding channel frame 400 can have sliding channels 420, 430 and a rack body portion 470. The sliding channels 420, 430 can include a sliding channel top portion 430 and a sliding channel bottom portion 420. The top and bottom sliding channels 420, 430 can each include a sliding slot 450.

The display sliding channel frame 400 can be a thin, rectangular shaped rack configured to slidably fit a plurality of swatch pieces 200, 300. For example, the height of the sliding rack body portion 470 can be about same or similar to the height of the swatch pieces 200, 300. The width of the sliding channel frame 400 can be about equal to or greater than the width of each swatch piece 200, 300. The top and bottom sliding channels 420, 430 can be on the top and bottom edges of the sliding rack body portion 470. The top and bottom sliding channels 420, 430 can be configured to complement the shape and size of the top and bottom rail portions 230, 232, 330, 332 of the swatch pieces 200, 300 described above in reference to FIGS. 8 and 9. The sliding slot 450 can have a thickness configured to complement the thickness of the top and bottom rail portions 230, 232, 330, 332, such that a user or a customer is able to slide each individual swatch piece 200, 300 within the display sliding channel frame 400.

The display track frame 400 can be placed in and/or attached to the front of a product shelving tray, such as the product shelving tray 110 shown and described above in reference to FIGS. 7A-7B. As shown in FIG. 10, the user or a customer can slide in, or remove swatch pieces 200, 300 from either side of the display sliding channel frame 400. By removing and replacing the swatch pieces 200, 300, a user or a customer is able to organize the product based on its features such as color, brush type, etc.

A user can advantageously associate the color of the nail polish 100 in each elongate column 104 by looking at the color and the label of the swatch piece 200. By being able to associate the color or brand of the nail polish 100 and the swatch piece 200, a user can efficiently organize nail polish containers 100. The color of a nail polish can be different when viewed from outside of the nail polish container as opposed to when it is actually applied to the nail, due to change in color gradient. A user can advantageously detach the swatch piece 200 and place it above the nail to see how a nail polish inside a nail polish container 100 would look like once applied. A user can advantageously take out a nail polish container 100 for use, and return it to the product shelving tray 110 at an appropriate elongate column 104 by looking at the swatch piece 200, without having to guess the color, brand, or serial number of the nail polish.

A user or a customer may grasp or grip a swatch piece 200 releasably attached to the frame 400. The frame can be configured for attachment to an elongate row of product shelving organizing beauty products in elongate columns that are perpendicular with respect to the elongate row, the frame further configured to releasably accept multiple swatch pieces 200 and associate each swatch piece 200 with a corresponding elongate column of beauty products by positioning one swatch piece adjacent to—and aligning that swatch piece with—each elongate column of beauty products. The user may slide the swatch piece 200 along the sliding channel 420, 430 of the frame, away from its first position where the swatch piece 200 can be associated with the corresponding elongate column of beauty products. As shown in FIG. 10, the user may slide the swatch piece 200 in a longitudinal direction of the frame to release the swatch piece 200 from the frame 400. The user or consumer may place the swatch piece 200 released from the frame 400 above a body part where the sample product may be applied. The body part may include fingernails, toenails, eyelids, skin, hair, etc.

A user or customer may place one or more swatch pieces 200 into the sliding channel 420, 430 of the frame 400. A user or the customer may slide each swatch piece 200 to place them in the order that each beauty product is placed in each elongate columns of the product shelving tray 110, such that each swatch piece 200 can align with and/or correspond to the type of beauty product placed in the corresponding column of the product shelving tray 110.

Theft Deterrent Channel Lock

Figure 11:
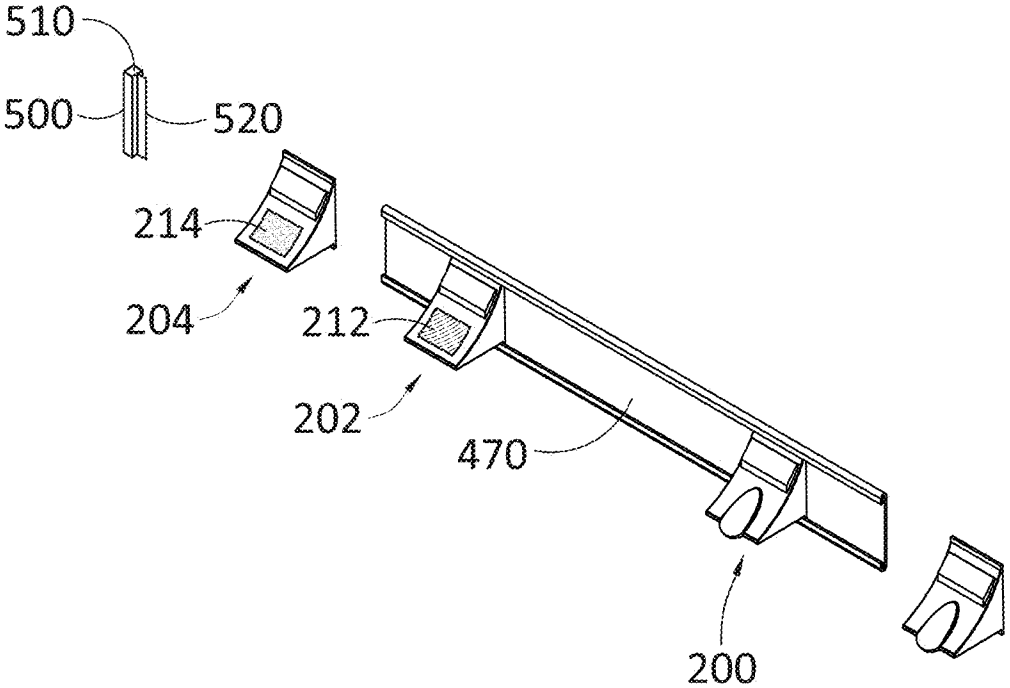
FIG. 11 illustrates an example display system, including a sliding channel rack and swatch pieces, and how they can relate to each other.

FIG. 11 illustrates an example system that includes a sliding channel rack and swatch pieces with a theft deterrent channel lock, and how they can relate to each other. The display sliding channel frame 400 can have a theft deterrent channel lock 500. The theft deterrent channel lock 500 can have a plug 510 and a cap 520. The plug 510 can be shaped and sized to slide into the rack body portion 470. For example, the plug 510 can be shaped and sized to reciprocate the shape and size of the rack body portion 470, such as by having similar shape and size as the back surface 250, the top rail portion 230, and the bottom rail portion 232 of the swatch piece 200. The cap 520 can be shaped and sized to prevent the theft deterrent channel lock 500 from sliding further into the rack body portion 470. For example, the cap 520 can have a length greater than the length between the top and bottom sliding slots 420, 430 and a width greater than the width of the sliding slot 450. The theft deterrent channel lock 500 can be removably attached to the rack body portion 470. The theft deterrent channel lock 500 can be bonded, fastened, or otherwise restrained from movement once attached to the rack body portion 470.

The theft deterrent channel lock 500 can be used to prevent the removal and/or sliding of the swatch pieces 200. By preventing removal and/or sliding of the swatch pieces 200, a user may advantageously prevent the swatch pieces 200 from being displaced, stolen, or becoming disorganized.

The term "nail polish" as used herein is a broad term and is used, in accordance with its ordinary meaning, to refer to any nail decorations. For example, the term "nail polish" can include, without limitation, any decoration that can change or enhance the look of fingernails or toenails. The term "nail polish" can include some or all of the following, alone or in combination: nail gel, nail fabric, fake nails, spangles, stickers, paint, wraps, shells, etc. Moreover, each time an example uses nail polish as an example product, various other products can be substituted, including all beauty products, and all products for which a close examination of a color or other visual property may be warranted or desirable for consumers. In addition to the beauty products described herein, such products can include paints and stains, fabrics, color pencils, and hobby/crafts products.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

What is claimed is:

1. A beauty product sample display system comprising:

a frame configured for attachment to an elongate row of product shelving configured to hold beauty products in one or more elongate columns that are nonparallel with respect to the elongate row, the elongate row of product shelving further configured to be positioned near a consumer space such that the one or more elongate columns of beauty products are visible to a consumer, the beauty products arranged adjacent to one another in the one or more elongate columns, the frame further configured to support one or more swatch pieces and associate each of the one or more swatch pieces with a corresponding one of the one or more elongate columns of beauty products by positioning each of the one or more swatch pieces adjacent to and aligning with the corresponding one of the one or more elongate columns of beauty products; and one or more of the swatch pieces, each comprising:

a rigid plastic sample portion that can be configured to contain or display a beauty product sample and expose the beauty product sample's color or other visual properties for inspection by the consumer when that consumer is present in the consumer space, each sample portion configured to protrude outward, away from the product shelving and into the consumer space to allow the consumer to interact with the sample portion and evaluate the color or other visual properties;

each sample portion comprising a fingernail-shaped section having each of the following:

a superior convex surface configured to be directly exposed and visible to the consumer for containing or displaying the beauty product sample while generally covering a fingernail of the consumer; a corresponding anterior concave surface configured to allow the consumer's fingernail to nest immediately adjacent thereto and a corresponding anterior space underneath the concave surface of sufficient size that the consumer in the consumer space can place the consumer's fingernail immediately underneath the sample portion to see a visual effect the beauty product sample would produce if placed directly on the consumer's fingernail;

a fingernail tip extending generally toward the frame and having an upper edge;

a fingernail base extending away from the frame toward the consumer space, the fingernail base having a lower curved edge that is shaped to abut a standard cuticle of the consumer's fingernail such that the sample portion tends to fully cover the fingernail and display the beauty product sample's color or other visual properties adjacent the skin of the consumer when the consumer places the consumer's fingernail immediately underneath the sample portion in the anterior space;

each sample portion further comprising a remainder section configured to support the fingernail-shaped section and cause it to protrude outward, away from the product shelving and into the consumer space, thereby creating the anterior space underneath the concave surface of the fingernail-shaped section, each remainder section having:

a flat label portion that can be configured to contain or display a label identifying a name or source of the beauty product sample contained or displayed in the sample portion, the flat label portion associated with the sample portion and facing up and into the consumer space;

a border between the remainder section and the fingernail-shaped section, the border having a generally inverted U shape that is sized and configured to abut the upper edge of the fingernail tip of the fingernail-shaped section of the sample portion while allowing the superior convex surface of the sample portion to bulge upwardly into the consumer space; and at least one engagement protrusion extending downwardly from a back of the remainder section in a direction away from the customer space and generally perpendicular to a bottom surface of the remainder section;

the one or more swatch pieces configured to align with the corresponding one or more elongate columns of beauty products.

2. A beauty product sample display comprising:

one or more swatch pieces, each comprising:

a rigid plastic sample portion that can be configured to contain or display a beauty product sample and expose the beauty product sample's color or other visual properties for inspection by a consumer when that consumer is present in a consumer space, each sample portion configured to protrude outward, away from product shelving and into the consumer space to allow the consumer to interact with the sample portion and evaluate the color or other visual properties;

each sample portion comprising a fingernail-shaped section having each of the following:

a superior convex surface configured to be directly exposed and visible to the consumer for containing or displaying the beauty product sample while generally covering a fingernail of the consumer;

a corresponding anterior concave surface configured to allow the consumer's fingernail to nest immediately adjacent thereto and a corresponding anterior space underneath the concave surface of sufficient size that the consumer in the consumer space can place the consumer's fingernail immediately underneath the sample portion to see a visual effect the beauty product sample would produce if placed directly on the consumer's fingernail;

a fingernail tip extending generally toward the product shelving and having an upper edge;

a fingernail base extending away from the product shelving toward the consumer space, the fingernail base having a lower curved edge that is shaped to abut a standard cuticle of the consumer's fingernail such that the sample portion tends to fully cover the fingernail and display the beauty product sample's color or other visual properties adjacent the skin of the consumer when the consumer places the consumer's fingernail immediately underneath the sample portion in the anterior space;

each sample portion further comprising a remainder section configured to support the fingernail-shaped section and cause it to protrude outward, away from the product shelving and into the consumer space, thereby creating the anterior space underneath the concave surface of the fingernail shaped section, each remainder section having:

a flat label portion that can be configured to contain or display a label identifying a name or source of the beauty product sample contained or displayed in the sample portion, the flat label portion associated with the sample portion and facing up and into the consumer space;

a border between the remainder section and the fingernail-shaped section, the border having a generally inverted U shape that is sized and configured to receive and abut the upper edge of the fingernail tip of the fingernail-shaped section of the sample portion while allowing the superior convex surface of the sample portion to bulge upwardly into the consumer space in the same direction that the flat label portion faces; and at least one engagement protrusion extending downwardly from a back of the remainder section in a direction opposite and away from the direction the flat label portion faces, such that the at least one engagement protrusion protrudes generally perpendicular to a bottom surface of the remainder section;

wherein the one or more swatch pieces are configured for attachment to an elongate row of product shelving configured to hold beauty products in one or more elongate columns that are nonparallel with respect to the elongate row, the elongate row of product shelving further configured to be positioned near the consumer space such that the one or more elongate columns of beauty products are visible to the consumer, the beauty products arranged adjacent to one another in the one or more elongate columns, the product shelving further configured to accept and support the one or more swatch pieces and associate each of the one or more swatch pieces with a corresponding one of the one or more elongate columns of beauty products by aligning each of the one or more swatch pieces with the corresponding one or more elongate columns of beauty products; and the one or more swatch pieces are further configured for insertion and support by product shelving that comprises one or more openings for accepting the at least one engagement protrusion of the one or more swatch pieces, the one or more openings positioned to allow the one or more swatch pieces to align with the corresponding one or more elongate columns of beauty products.

3. The display of claim 2, further comprising a frame that forms part of the product shelving, the frame having a hanging portion configured for removable insertion into a slot in the product shelving, the frame configured to facilitate attachment of the one or more swatch pieces to the product shelving.

4. The display of claim 2, wherein the one or more openings of the product shelving comprise at least one channel providing an open groove in a surface of the product shelving configured to accept and guide the at least one engagement protrusion, thereby assisting in physical support and alignment of the one or more swatch pieces with the corresponding one or more elongate columns of beauty products.

5. The display of claim 3, wherein the at least one engagement protrusion comprises a button configured in association with the frame as follows:

a button hole configured to removably lodge the button;

a channel in the frame extending from a deeper end and tapering to a more shallow end closer to a product area within the product shelving, the channel extending and tapering toward the button hole but not connecting thereto; and a ridge disposed between the channel and the button hole such that the button can slide through the channel, over the ridge, and snap down into the button hole, and the frame can thereby retain the one or more swatch pieces.

6. The display of claim 5, wherein the display is configured such that the one or more swatch pieces experience limited torsional stress during insertion and removal, the stress reaching a maximum when the button passes over the ridge.

7. A beauty product sample display comprising:

one or more swatch pieces comprising a sample portion configured to display visual properties or other traits of a beauty product, such as texture, reflectivity, odor, durability, ability to withstand water or other treatments for inspection by a consumer, the sample portion configured to protrude so that the consumer can interact with the sample portion and evaluate the visual properties or other traits of the beauty product;

each sample portion comprising a fingernail-shaped section having each of the following:

a superior curved surface configured to be directly exposed and visible to the consumer for displaying visual properties or other traits of the beauty product while generally covering the consumer's fingernail;

a corresponding anterior opening configured to allow the consumer's fingernail to nest immediately adjacent thereto such that the consumer in a consumer space can place the consumer's fingernail immediately underneath the sample portion to see a visual effect the beauty product would produce if placed over the consumer's fingernail;

a fingernail tip extending generally toward product shelving and having an upper edge supported by the swatch piece; and a fingernail base extending away from the product shelving toward the consumer space, the fingernail base having a lower curved edge that is shaped to abut a standard cuticle of the consumer's fingernail such that the sample portion tends to cover the fingernail and display visual properties or other traits of the beauty product adjacent the skin of the consumer;

the one or more swatch pieces further comprising at least one slot engagement protrusion in the form of a button configured for placement within a hole in a frame, and the button is generally perpendicular to a bottom surface of a respective swatch piece;

wherein the one or more swatch pieces are configured for support by the frame attachable to an elongate row of the product shelving containing beauty products arranged adjacent to one another in one or more elongate columns that are nonparallel with respect to the elongate row, the elongate row of product shelving for positioning near the consumer space such that the one or more elongate columns configured to contain beauty products are visible or accessible to the consumer, the frame configured to provide a retention mechanism that accepts and supports the one or more swatch pieces, wherein the retention mechanism comprises the hole.

8. The display of claim 7, wherein the one or more swatch pieces comprise a label portion that can be configured to contain or display a label identifying a name or source of the beauty product of the sample portion.

9. The display of claim 7, further comprising the frame, wherein the frame is configured for removable attachment to the product shelving.

10. The display of claim 9, wherein the frame includes a plurality of channels, each of the channels configured for accepting the at least one slot engagement protrusion of the one or more swatch pieces, the channels positioned to allow the one or more swatch pieces to align with the one or more elongate columns of beauty products.

11. The display of claim 10, wherein the at least one slot engagement protrusion is configured to be accepted by the channels to assist in physical support and alignment of the one or more swatch pieces with the one or more elongate columns of beauty products.

12. A beauty product sample display system comprising:

a frame configured for attachment to an elongate row of product shelving configured to hold beauty products in one or more elongate columns that are nonparallel with respect to the elongate row, the elongate row of product shelving further configured to be positioned near a consumer space such that the one or more elongate columns of beauty products are visible or accessible to a consumer, the beauty products arranged adjacent to one another in the one or more elongate columns;

wherein the frame is configured to accept and support one or more swatch pieces, each of the one or more swatch pieces comprising:

a rigid plastic sample portion that can be configured to contain or display visual properties or other traits of a beauty product for inspection by the consumer, each sample portion configured to protrude directly outward into the consumer space to allow the consumer to interact with the sample portion and evaluate the visual properties or other traits of the beauty product; and at least one engagement protrusion comprising a button configured to slide in at least one channel formed by a surface of the frame;

the frame further comprising frame openings for accepting the one or more swatch pieces and allowing them to clip into the frame;

wherein each sample portion is thin rigid plastic generally shaped like a fingernail with a fingernail tip extending toward the frame, a fingernail base extending away from the frame toward the consumer space to create a finger space large enough for the consumer to place the consumer's finger under the sample portion and position the sample portion immediately above the consumer's fingernail to see a visual effect the beauty product would produce if applied directly to the fingernail.

13. The system of claim 12, wherein each of the one or more swatch pieces further comprises a label portion configured to contain or display a label identifying a name or source of the beauty product contained or displayed in the sample portion.

14. The system of claim 13, wherein the sample portion has:

a superior concave surface configured to be directly exposed and visible to the consumer for containing or displaying the beauty product while generally covering the consumer's fingernail;

a corresponding anterior convex surface configured to allow the consumer's fingernail in the finger space to nest immediately adjacent thereto; and a curved edge shaped to abut a standard cuticle of the consumer such that the sample portion tends to fully cover the consumer's fingernail and display visual properties or other traits of the beauty product adjacent the skin of the consumer.

15. The system of claim 13, wherein each of the one or more swatch pieces further comprises a remainder portion partially surrounding the sample portion, the fingernail shape of the sample portion extending beyond the remainder portion such that the consumer may view the consumer's skin adjacent to the sample portion when the consumer's finger is in the finger space.

16. The system of claim 15, wherein the sample portion and the remainder portion are connected at a fingernail tip end of the sample portion closest to the product shelving.

17. The system of claim 13, wherein the frame is further configured for removable attachment to the product shelving and includes a hanging portion that, when oriented for attachment to the product shelving, extends downwardly in a direction opposite to a direction the label portion faces.

18. The system of claim 13, wherein each of the one or more swatch pieces further comprises at least one engagement protrusion configured to be accepted by the frame openings to assist in physical support and alignment of the one or more swatch pieces with the one or more elongate columns of beauty products.

19. The system of claim 12, wherein the sample portion is configured to display one or more fingernail polish samples by protruding outward, away from product shelving and into the consumer space to allow the consumer to place the consumer's fingernail under the sample portion and evaluate the color or other visual properties of the one or more fingernail polish samples; and wherein each sample portion comprises a fingernail-shaped section having each of the following:

a superior convex surface configured to be directly exposed and visible to the consumer for displaying the one or more fingernail polish samples while generally covering the consumer's fingernail;

a corresponding anterior concave surface configured to allow the consumer's fingernail to nest immediately adjacent thereto and a corresponding anterior space underneath the concave surface of sufficient size that the consumer in the consumer space can place the consumer's fingernail immediately underneath the sample portion to see a visual effect the one or more fingernail polish samples would produce if placed directly on the consumer's fingernail;

a fingernail tip extending generally toward the product shelving and having an upper edge; and a fingernail base extending away from the product shelving toward the consumer space, the fingernail base having a lower curved edge that is shaped to abut a standard cuticle of the consumer's fingernail such that the sample portion tends to fully cover the consumer's fingernail and display one or more colors of the one or more fingernail polish samples adjacent the skin of the consumer when the consumer places the consumer's fingernail immediately underneath the sample portion in the anterior space.

20. The beauty product display swatch piece of claim 19, wherein:

each sample portion further comprises a remainder section configured to support the fingernail-shaped section and cause it to protrude outward, away from the product shelving and into the consumer space, thereby creating the anterior space underneath the concave surface of the fingernail-shaped section, each remainder section having:

a flat label portion that can be configured to contain or display a label identifying a name or source of the one or more fingernail polish samples displayed in the sample portion, the flat label portion associated with the sample portion and facing up and into the consumer space;

a border between the remainder section and the fingernail-shaped section, the border having a generally inverted U shape that is sized and configured to abut the upper edge of the fingernail tip of the fingernail-shaped section of the sample portion while allowing the superior convex surface of the sample portion to bulge upwardly into the consumer space; and at least one engagement protrusion extending downwardly from a back of the remainder section in a direction away from the consumer space.

21. The beauty product display swatch piece of claim 2, wherein the one or more openings for accepting the at least one engagement protrusion of the one or more swatch pieces comprise one or more sliding slots, the one or more sliding slots configured to allow the one or more swatch pieces to align with the corresponding one or more elongate columns of beauty products by allowing the one or more swatch pieces to slide laterally into alignment.

* * * * *